US005863389A

United States Patent [19]

White et al.

[11] Patent Number: 5,863,389

[45] Date of Patent: Jan. 26, 1999

[54] PULP BLEACHING REACTOR FOR DISPERSING HIGH CONSISTENCY PULP INTO A GASEOUS BLEACHING AGENT CONTAINING OZONE

[75] Inventors: David E. White, Pennington; Michael A. Pikulin, Bound Brook; Thomas P. Gandck, Trenton, all of N.J.; William H. Friend, Savannah, Ga.

[73] Assignee: Union Camp Patent Holding, Inc., Wayne, N.J.

[21] Appl. No.: 208,063

[22] Filed: Mar. 8, 1994

Related U.S. Application Data

[60] Continuation of Ser. No. 751,261, Aug. 28, 1991, abandoned, which is a division of Ser. No. 604,849, Oct. 26, 1990, Pat. No. 5,181,989.

[51] Int. Cl.[6] ..... D21C 7/00; D21C 9/153

[52] U.S. Cl. ..... 162/241; 162/243; 162/246; 422/225; 422/229

[58] Field of Search ..... 162/52, 246, 65, 162/17, 19, 18, 241, 243, 237, 57, 244; 422/225, 226, 229, 224

[56] References Cited

U.S. PATENT DOCUMENTS

| | | | |
|---|---|---|---|
| 1,591,070 | 7/1926 | Wolf . | |
| 1,642,978 | 9/1927 | Thorne . | |
| 1,643,566 | 9/1927 | Thorne . | |
| 1,781,712 | 11/1930 | Wallace | 162/68 |
| 1,818,913 | 8/1931 | Van De Carr, Jr. . | |
| 1,957,937 | 5/1934 | Campbell et al. | 8/2 |
| 2,013,115 | 9/1935 | Thorne | 8/2 |
| 2,431,478 | 11/1947 | Hill . | |
| 2,466,633 | 4/1949 | Brabender et al. . | |
| 3,318,657 | 5/1967 | Wade | 8/111 |
| 3,630,828 | 12/1971 | Liebergott et al. . | |
| 3,660,225 | 5/1972 | Verreyne et al. | 162/17 |

(List continued on next page.)

FOREIGN PATENT DOCUMENTS

| | | |
|---|---|---|
| 966604 | 4/1975 | Canada . |
| 970111 | 7/1975 | Canada . |
| 1103409 | 6/1981 | Canada . |
| 1119360 | 3/1982 | Canada . |
| 1132760 | 10/1982 | Canada . |
| 1112813 | 11/1982 | Canada . |
| 1154205 | 9/1983 | Canada . |
| 1181204 | 1/1985 | Canada . |
| 1186105 | 4/1985 | Canada . |
| 1310292 | 11/1992 | Canada . |

(List continued on next page.)

OTHER PUBLICATIONS

Agrawal et al., Performance of Trough Paddle Mixing Conveying System for Treatment of Wheat Straw with Small Volumes of Liquids, p. 18.

Allison, R.W., "Effect of Ozone on High–Temperature Thermomechanical Pulp", *Appita,* vol. 32, No. (Jan. 1979) p. 279.

Allison, R.W., "Efficient Ozone and Peroxide Bleaching of Alkaline Pulps From Pinus Radiata," *Appita,* vol. 36, No. 1 (jul. 1982) p. 42.

Allison, "Production of Bleached Softwood Pulp by Low Pollution Processes", Wood Sci. Technol. 17, pp. 129–137 (1983).

Backlund, A., "A Progress Report on Continuous Digester Development", Paper Presented to the 21st EUCEPA International Conference–Torremolinos, Spain.

(List continued on next page.)

*Primary Examiner*—Steven Alvo

*Attorney, Agent, or Firm*—Pennie & Edmonds LLP

[57] ABSTRACT

An apparatus for delignifying and bleaching a lignocellulosic pulp without the use of elemental chlorine. The bleaching reactor is a horizontal vessel having a central rotatable shaft which preferably contains paddles, cut and folded screw flights or a ribbon flight, to disperse and advance the pulp particles in a plug flow manner while contacting and mixing the pulp particles with a gaseous bleaching agent such as ozone for substantially uniform bleaching thereof.

23 Claims, 15 Drawing Sheets

U.S. PATENT DOCUMENTS

| | | | |
|---|---|---|---|
| 3,663,357 | 5/1972 | Liebergott | 162/65 |
| 3,703,435 | 11/1972 | Schleinofer | 162/17 |
| 3,725,193 | 4/1973 | De Montigny et al. . | |
| 3,785,577 | 1/1974 | Carlsmith | 241/57 |
| 3,814,664 | 6/1974 | Carlsmith | 162/236 |
| 3,832,276 | 8/1974 | Roymoulik et al. | 162/65 |
| 3,964,962 | 6/1976 | Carlsmith | 162/236 |
| 4,046,621 | 9/1977 | Sexton | 162/40 |
| 4,080,249 | 3/1978 | Kempf et al. | 162/57 |
| 4,093,056 | 6/1978 | Richter . | |
| 4,119,486 | 10/1978 | Eckert | 162/65 |
| 4,123,317 | 10/1978 | Fritzvold . | |
| 4,155,806 | 5/1979 | Mannbro | 162/19 |
| 4,158,597 | 6/1979 | Petersson | 162/238 |
| 4,196,043 | 4/1980 | Singh . | |
| 4,216,054 | 8/1980 | Bentvelzen et al. | 162/57 |
| 4,229,252 | 10/1980 | Merredith | 162/65 |
| 4,274,918 | 6/1981 | Zilka | 162/237 |
| 4,278,496 | 7/1981 | Frtizvold . | |
| 4,279,694 | 7/1981 | Fritzvold et al. | 162/28 |
| 4,283,251 | 8/1981 | Singh | 162/17 |
| 4,298,426 | 11/1981 | Torregrossa et al. . | |
| 4,363,697 | 12/1982 | Markham et al. . | |
| 4,372,812 | 2/1983 | Phillips | 162/40 |
| 4,426,256 | 1/1984 | Johnson . | |
| 4,444,621 | 4/1984 | Lindahl | 162/26 |
| 4,450,044 | 5/1984 | Fritzvold et al. | 162/65 |
| 4,468,286 | 8/1984 | Johnson . | |
| 4,563,243 | 1/1986 | Koch et al. | 162/18 |
| 4,619,733 | 10/1986 | Kooi | 162/30.1 |
| 4,640,782 | 2/1987 | Burleson | 210/748 |
| 4,818,339 | 4/1989 | Lamort | 162/4 |
| 4,913,358 | 4/1990 | Sbaschingg et al. . | |
| 4,959,124 | 9/1990 | Tsai | 162/49 |
| 5,164,043 | 11/1992 | Griggs et al. | 162/65 |
| 5,181,989 | 1/1993 | White et al. | 162/65 |
| 5,238,501 | 8/1993 | Kappel et al. . | |

FOREIGN PATENT DOCUMENTS

| | | | |
|---|---|---|---|
| 062539 | 10/1982 | European Pat. Off. . | |
| 106460 | 4/1984 | European Pat. Off. . | |
| 106609 | 4/1984 | European Pat. Off. . | |
| 276608 | 3/1988 | European Pat. Off. . | |
| 308314 | 3/1989 | European Pat. Off. . | |
| 1441787 | 5/1966 | France . | |
| 2620744 | 9/1987 | France | 162/65 |
| 2609067 | 7/1988 | France | 162/65 |
| 53-31964 | 9/1978 | Japan | 162/65 |
| WO88/05095 | 7/1988 | WIPO . | |

OTHER PUBLICATIONS

Balousek, "The Effects of Ozone Upon Lignin Model Containing the B–aryl Ether Linkage", Svensk Papperstidning, No. 9, 1981.

Carlberg et al., "Bleaching of Sulphite and Sulphate Pulps Using Conventional and Unconvential Sequences", TAPPI Proceedings 1982 Annual Meeting, p. 381.

Casey, J.P., "Bleaching: A Perspective", *TAPPI Journal,* vol. 66, No. 7 (Jul. 1983) p. 95.

Dyck, A.W.J., "New Advances in Mechanical Pulping", *American Paper Industry* (Spe. 1971) p. 21.

Eickeler, "Ozone Measurement with Detector Tubes".

Eriksson and Gierer, "Ozonation of Residual Lignin".

Fujii, et al., "Oxygen Pulping of Hardwoods," TAPPI, Alkaline Pulping/Secondary Fibers Conference (Washington, D.C., Nov. 7–10, 1977).

Gangolli, "The Uses of Ozone and Pulp in the Paper Industry".

Germgard and Sjorgren, "Ozone Prebleaching of a Modified–Cooked and Oxygen–Bleached Softwood Kraft Pulp", Svensk Papperstidning, No. 15, (1985).

Germgard et al., "Mathematical Models for Simulation and Control of Bleaching Stages", Nordic Pulp and Paper Research Journal, No. 1 (1987).

Gierer, "Chemistry of Delignification, Part 2: Reactions of Lignins During Bleaching", Word Science and Technology (1986).

Godsay and Pearce, "Physico–Chemical Properties of Ozone Oxidized Kraft Pulps", Oxygen Delignification (1984).

Grant, R.S., "Displacement Heating Trials With a New Process to Reduce Steam", *TAPPI Journal* (Mar. 1983) p. 120.

Gupta, et al., "U.S. Patent Prebleaching, Influence on Viscosity and Sheet Strength", TAPPI Symposium–Oxygen Delignification, p. 1 (1984).

Hill and Rice, "Handbook of Ozone Technology and Applications", Ann Arbor Science.

Hiraoka et al., "Two Dimensional Model Analysis of Flow Behavior of Highly Viscous Non–Newtonian Fluid in Agitated Vessel With Paddle Impeller", Journal of Chemical Eng. of Japan, p. 56.

Hiraoka et al., "Two Dimensional Model Analysis of Turbulent Flow in an Agitated Vessel With Paddle Impeller", Chem. Eng. Commun., p. 149.

Heimburger et al., "Kraft Mill Bleach Plant Effluents: Recent Developments Aimed at Decreasing Their Environmental Impact".

Heimburger et al., "Kraft Mill Bleach Plant Effluents: Recent Developments Aimed at Decreasing Their Environmental Impacr Part II", TAPPI Journal, p. 69 (Nov. 1988).

Katai and Schuerch, "Mechanism of Ozone Attack on Alpha–Methyl Glucoside and Cellulosic Materials".

Kibblewhite et al., "Effects of Ozone on the Fibre Characteristics of High–Temperature Thermomechanical Pulp", Proceedings of the 1979 International Mechanical Pulping Conference, p. 293.

Kratzl et al., "Reactions of Lignin and Lignin Model Compounds With Ozone", *TAPPI,* vol. 59, No. 11 (Nov. 1976) p. 86.

Leopold, B., "The Pulp Mill of the Future", *Textile and Paper Chemistry and Technology,* p. 239.

Leopold, B., "The Pulping Process—Opportunity or Headache?", Proceedings of IPC Conference, Paper Science and Technology, May 8–10, 1979.

Liebergott et al., "The Use of Ozone or Oxygen in the First Bleaching tage", *Ozone: Science and Engineering,* vol. 4, p. 109 (1982).

Liebergott, et al., "The Use of Ozone in Bleaching and Brightening Wood Pulps: Part I—Chemical Pulps" (TAPPI 1978), p. 90.

Liebergott, N., "Paprizone Process for Brightening and Strengthening Groundwood", *Paper Trade Journal* (Aug. 2, 1971) p. 28.

Liebergott, N., Technical Paper T214—"Sequential Treatment of Mechanical Pulps at High Consistency with $H_2O_2$ and $O_3$— The Paprizone Process–Effect on Pulp Brightness and Strength", *Pulp and Paper Magazine of Canada,* vol. 73, No. 9, (Sep. 1972) p. 70.

Liebergott, et al., "Bleaching a Softwood Kraft Pulp Without Chlorine Compounds", TAPPI Journal, p. 76 (Aug. 1984).

Liebergott, et al., "Bleaching a Softwood Kraft Pulp Without Chlorine Compounds", pp. 1–10.
Liebergott, et al., "Comparison Between Oxygen and Ozone Delignification in the Bleaching of Kraft Pulps", TAPPI Proceedings—1981 Pulping Conference, p. 157.
Liebergott et al., "Ozone Delignification of Bleach Spruce and Hardwood Kraft, Kraft Anthraquinone, and Soda–Anthraquinone", *TAPPI,* vol. 64, No. 6 (Jun. 1981) p. 95.
Lindholm, "Effect of Heterogeneity in Pulp Bleaching with Ozone", Paperi ja Puu, (Apr. 1986).
Lindholm, "Effect of Pulp Consistency and pH in Ozone Bleaching", Part I.
Lindholm, "Effect of Pulp Consistency and pH in Ozone Bleaching; Part 2", International Oxygen Delignification Conference (1987).
Lindholm, "Effect of Pulp Consistency and pH in Ozone Bleaching", Paperi ja Puu, (Mar. 1987), Part IV.
Lindquist et al., "Ozone Bleaching of Sulfite Pulps", TAPPI Proceedings of the 1982 International Sulfite Pulping Conference, p. 127.
Lindquist, "Ozone Bleaching of Sulfite Pulps", *Svensk Papperstidning* (Nov. 6, 1984) p. 54.
Loras et al., "Bleaching of Sulphite Pulps With Oxygen and Ozone", Report of 1982 International Pulp Bleaching Conference, p.45.
Loras, V., "Bleachability of Mechanical Pulp", *TAPPI ,* vol. 57, No. 2 (Feb. 1974) p. 98.
Mbachu et al., "The Effect of Acetic and Formic Acid Pretreatment on Pulp Bleaching With Ozone", *TAPPI,* vol. 64, No. 1(Jan. 1981) p. 67.
Melnyk et al., "An Ozone Reactor for Color Removal From Pulp Bleachery Wastes", Chemical Abstracts, p. 434.
Meredith, "Ozone Mass Transfer Agitated Low Consistency", Wood Pulp, Sep. 9, 1981.
Norden and Simonson, "Ozone Bleaching of Sulphite Pulp—A Pilot Plant Study".
*Norsk Skogindustri,* "Pilot Scale Reseacrh at PFI", (Oct. 1980) p. 228.
N. Soteland, "Bleaching of Chemical Pulps With Oxygen and Ozone," *Pulp and Paper Magazine of Canad* (1974), p. T–153.
Ohnishi, K., "Japan: Pulping, Bleaching", *Pulp and Paper* (Aug. 1978) p. 88.
Ouederni, "Simulation of the Ozone/Lignin Reaction in an Agitated Vessel".
Ow, et al., "Advances In Ozone Bleaching: Part II—Bleaching of Softwood Kraft Pulps With Oxygen and Ozone Combination", TAPPI Symposium—Oxygen Delignification (1984).
Partridge, H., "New Pulp Bleaching Developments", *CEP* (Jun. 1976).
Partridge, H., "An Overview of New Pulp Bleaching Developments" AIChE National Meeting, Paper No. 24a. (Sep. 7–10, 1975).
Patt, et al., "Use of Ozone For Pulp Bleaching", Papier, 42 (10A), V 14–23 (1988).
Perkins et al., "Advances in Ozone Bleaching—Part III—Pilot Plant Installations and Proposed Commercial Implementation".
Pettersson, B. et al. "Advances in Technology Make Batch Pulping as Efficient as Continuous", *Pulp & Paper* (Nov. 1985) p. 90.
PPI, "Naco Straw Pulp", Article, (Apr. 1987).
Procter, A.R., "Ozone for Treatment of High Kappa Kraft Pulps", *Pulp and Paper Magazine of Canada,* vol. 75, No. 6 (Jun. 1974) p. 58.
*Pulp & Paper,* "Ozone Bleaching Has Potential For Closing Pulp Mill Water Systems", (Jul. 1978) p. 76.
Rothenberg S. et al., "Bleaching of Oxygen Pulps With Ozone", p. 175.
Rothenberg S. et al., "Bleaching of Oxygen Pulps with Ozone", *TAPPI Journal* (Aug. 1975) p. 182.
Rothenberg et al., "Ozone Bleaching of Oxygen Pulp", Proceedings of the 1982 Pulping Conference, p. 341.
Rutkowski et al., "Investigations on Bleaching of Sulphate Pine Pulp With Ozone", *Cellulose Chem. Technol.,* vol. 18 (1984) p. 323.
Schuerch, "Ozonization of Cellulose and Wood, Journal of Polymer Science", No. 2, (1963).
Secrist et al., "Kraft Pulp Bleaching. II. Studies on the Ozonation of Chemical Pulps", *TAPPI,* vol. 54, No. 4 (apr. 1971) p. 581.
Secrist et al., "Studies on the Ozonation of Chemical Pulps", p. 215.
Seifert et al., "Engineering Consideration in the Design of Oxygen Reactors", p. 309.
Singh, "Ozone Replaces Chlorine in the First Bleaching Stage: Advances in Ozone Bleaching—Part I", TAPPI Journal, p. 48 (Feb. 1982).
Singh, "Advances in Ozone Bleaching—Part I: The Ozone Bleaching Process—Laboratory to Pilot Plant".
Smook, "Chapter 6—Sulfite Pulping", Handbook For Pulp & Paper Technologists (TAPPI).
Smook, "Chapter 7—Kraft Pulping", Handbook For Pulp & Paper Technologists (TAPPI).
Soteland, N., "Effect of Ozone on Mechanical Pulps", Extended Abstracts of 1976 Canadian Wood Chemistry Symposium, p. 13.
Soteland, N., "The Effect of Ozone on Mechanical Pulps", *Pulp and Paper Magazine of Canada,* vol. 78, No. 7 (Jul. 1977) p. 45.
Soteland, N., "Bleaching of Chemical Pulps With Oxygen and Ozone", Pulp and Paper Magazine of Canada, vol. 75, No. 4 (Apr., 1974) p. 91.
Soteland, N., "Bleaching of Chemical Pulps with Oxygen and Ozone", *Norsk Skogindustri* (Sep. 1978) p. 199.
Soteland, "Comparison Between Oxygen and Ozone Delignification of Sulphite Pulps", TAPPI Symposium–Oxygen Delignification p. 71 (1984).
Tenda et al., "Mixing Characterisctics and Optimum Conditions of a Horizontal Gas–Solid Agitated Vessel With Paddle–Blades on Double Paralell Axes", Kogaku, pp. 1–15.
Tritschler and Shelton, "Commercial Manufacture and Industrial Use of Ozone and an Oxidant".
Vidal and Molinier, "Ozonolysis of lignin–Improvement of in Vitro Digestibility of Poplar Sawdust", Biomass 16, (1988).
Winardi et al., "Pattern Recognition in Flow Visualization Around a Paddle Impeller", Journal C.E. in Japan, p. 503.
ASAM Pilot Plant Confirms Laboratory Test Results, by Kraftanlagen Heidelberg, "The Right Approach to Pollution–free Pulping".

20 RPM shaft speed
22 % of boxed area contains pulp

40 RPM shaft speed

47 % of boxed area contains pulp

60 RPM shaft speed

58% of boxed area contains pulp

PULP BLEACHING REACTOR FOR DISPERSING HIGH CONSISTENCY PULP INTO A GASEOUS BLEACHING AGENT CONTAINING OZONE

This Application is a Continuation of Ser. No. 07/751,261, filed Aug. 28, 1991, and now abandoned; which was a Division of Ser. No. 07/604,849, filed Oct. 26, 1990, now U.S. Pat. No. 5,181,989.

FIELD OF THE INVENTION

This invention relates to a novel apparatus for delignifying and bleaching lignocellulosic pulp with a gaseous bleaching agent such as ozone.

BACKGROUND OF THE INVENTION

To avoid the use of chlorine as a bleaching agent for pulp or other lignocellulosic materials, the use of ozone in the bleaching of chemical pulp has previously been attempted. Although ozone may initially appear to be an ideal material for bleaching lignocellulosic materials, the exceptional oxidative properties of ozone and its relatively high cost have previously limited the development of satisfactory ozone bleaching processes for lignocellulosic materials in general and especially for southern softwoods.

Ozone will readily react with lignin to effectively reduce the amount of lignin in the pulp, but it will also, under many conditions, aggressively attack the carbohydrate which comprises the cellulosic fibers of the wood to substantially reduce the strength of the resultant pulp. Ozone, likewise, is extremely sensitive to process conditions such as pH with respect to its oxidative and chemical stability. Changes in these process conditions can significantly alter the reactivity of ozone with respect to the lignocellulosic materials.

Since the delignifying capabilities of ozone were first recognized around the turn of the century, there has been substantial and continuous work by numerous persons in the field to develop a commercially suitable method using ozone in the bleaching of lignocellulosic materials. Furthermore, numerous articles and patents have been published in this area and there have been reports of attempts at conducting ozone bleaching on a non-commercial pilot scale basis. For example, U.S. Pat. No. 2,466,633 to Brabender et al., describes a bleaching process wherein ozone is passed through a pulp having a moisture content (adjusted to an oven dry consistency) of between 25 and 55 per cent and a pH adjusted to the range of 4 to 7.

Other non-chlorine bleach sequences are described by S. Rothenberg, D. Robinson & D. Johnsonbaugh, "Bleaching of Oxygen Pulps with Ozone", *Tappi,* 182–185 (1975)—Z, ZEZ, ZP and $ZP_a$ ($P_a$-peroxyacetic acid); and N. Soteland, "Bleaching of Chemical Pulps with Oxygen and Ozone", *Pulp and Paper Magazine of Canada*, T153–58 (1974)—OZEP, OP and ZP. Further, U.S. Pat. No. 4,196,043 to Singh discloses a multi-stage bleaching process utilizing ozone and peroxide which also attempts to eliminate the use of chlorine compounds, and includes recycling of effluents.

Various bleaching apparatus utilizing a central shaft with arm members attached thereto are generally known (see, e.g., U.S. Pat. Nos. 1,591,070 to Wolf, 1,642,978 and 1,643,566, each to Thorne, 2,431,478 to Hill, and 4,298,426 to Torregrossa et al.). Also, U.S. Pat. Nos. 3,630,828 to Liebergott et al. and 3,725,193 to de Montigny et al. each disclose a bleaching apparatus for use with pulp having a consistency of above 15 percent, which apparatus includes a rotating shaft having radially spaced breaker arms for comminuting the pulp. Richter U.S. Pat. No. 4,093,506 discloses a method and apparatus for the continuous distribution and mixing of high consistency pulp with a treatment fluid such as chlorine or chlorine dioxide. The apparatus consists of a concentric housing having a cylindrical portion, a generally converging open conical portion extending outwardly from one end of the cylindrical portion, and a closed wall extending inwardly from the other end of the cylindrical portion. A rotor shaft mounted within the housing includes a hub to which a plurality of arms are attached. These arms are each connected to a transport blade or wing. Rotation of the shaft allows the treatment fluid to be distributed in and mixed with the pulp "as evenly as possible."

Fritzvold U.S. Pat. No. 4,278,496 discloses a vertical ozonizer for treating high consistency (i.e., 35–50%) pulp. Both oxygen/ozone gas and the pulp (at a pH of about 5) are conveyed into the top of the reactor to be distributed across the entire cross-section, such that the gas comes in intimate contact with the pulp particles. The pulp and gas mixture is distributed in layers on supporting means in a series of subjacent chambers. The supporting means includes apertures or slits having a shape such that the pulp forms mass bridges thereacross, while the gas passes throughout the entire reactor in intimate contact with the pulp.

Displacement of pulp through the reactor takes place by the repeated but controlled breaking of the supporting means by the rotation of the breaking means which are attached to and rotated by a central shaft. This allows the pulp to pass through the apertures and into the subjacent chambers. Fritzvold et al. U.S. Pat. No. 4,123,317 more specifically discloses the reactor described in the aforementioned Fritzvold '496 patent. This reactor also is used for treating pulp with an oxygen/ozone gas mixture.

U.S. Pat. Nos. 4,468,286 and 4,426,256 each to Johnson disclose a method and apparatus for continuous treatment of paper pulp with ozone. The pulp and ozone are passed along different paths either together or separately.

U.S. Pat. No. 4,363,697 illustrates certain screw flight conveyors which are modified by including paddles, cut and folded screw flights or combinations thereof for use in the bleaching of low consistency pulp with oxygen.

French Patent 1,441,787 and European patent Application 276,608 each disclose methods for bleaching pulp with ozone. European Patent Application No. 308,314 discloses a reactor for bleaching pulp with ozone utilizing a closed flight screw conveyor, wherein the ozone gas is pumped through a central shaft for distribution throughout the reactor. The pulp has a consistency of 20–50% and the ozone concentration of the treating gas is between 4 and 10% so that 2 to 8% application of ozone on O.D. fiber is achieved.

Despite all of the research conducted in this area, however, no commercially feasible process for the manufacture of ozone bleached lignocellulosic pulps from softwood and related pulps, especially southern softwood, has heretofore been disclosed, and numerous failures have been reported.

The present invention provides a novel apparatus and gaseous bleaching process which overcomes the problems encountered in the prior art as discussed herein to produce a high grade bleached pulp in a commercially feasible manner.

SUMMARY OF THE INVENTION

The present invention relates to a novel reactor apparatus for bleaching pulp particles from a first GE brightness to a second, higher GE brightness with a gaseous bleaching agent such as ozone. This apparatus comprises a shell and means for introducing pulp particles into the shell. The pulp particles should have a consistency of above 20%, a first GE brightness and a particle size sufficient to facilitate substantially complete penetration of a majority of the pulp particles by a gaseous bleaching agent when exposed thereto.

The apparatus also includes means for introducing a gaseous bleaching agent into the shell and means for dispersing the pulp particles into the gaseous bleaching agent while advancing the pulp particles through the shell. The dispersing means comprises means for intimately contacting, mixing and dispersing and advancing the pulp particles with the gaseous bleaching agent while lifting, displacing and tossing the pulp particles in a radial direction, and advancing the pulp particles in an axial direction so that the gaseous bleaching agent flows and surrounds the lifted, displaced and tossed pulp particles. This exposes substantially all surfaces of the majority of the pulp particles to the gaseous bleaching agent.

The dispersing and advancing means advances the dispersed pulp particles in a plug flow-like manner for a sufficient residence time during which the temperature is maintained sufficient to achieve a mass transfer of the gaseous bleaching agent into the pulp particles. This in turn, produces substantially uniform bleaching throughout the majority of the pulp particles to form a bleached pulp having a second, higher GE brightness.

The residence time is based upon reactor dimensions, the feed rate of the incoming particles, and the configuration and operation of the dispersing and advancing means. Further, the shell the apparatus can be oriented so as to utilize the force of gravity to assist in the advancement of the pulp particles.

The gaseous bleaching agent introducing means controls the flow rate and residence time for the gaseous bleaching agent in the shell. This is achieved by control of the flow rate of the feed gas stream in conjunction with the fill level of solids in the reactor. The feed gas has a specific ozone concentration, such that the level of ozone applied to the pulp is as desired. Control of the feed gas flow rate and ozone concentration in conjunction with intimate mixing and contact with the pulp particles results in a high mass transfer of the gaseous bleaching agent into the pulp so as to bleach the pulp to the desired brightness level.

The pulp particle dispersing and advancing means preferably includes a paddle conveyor having a shaft extending through the shell along a longitudinal axis thereof and having a first end positioned adjacent to the end of the shell where the pulp particles enter, and a second end positioned adjacent to the end of the shell where the pulp particles exit. The shaft includes a plurality of paddle blades extending radially from and attached to the shaft and positioned and oriented in a predetermined pattern representative of the desired pitch of the paddle conveyor. In addition to pitch, the paddle spacing around the shaft, the paddle size and shape, and the paddle angle of orientation are selected to achieve the desired movement of pulp particles through the shell.

Alternatively, the pulp particle dispersing means may be a continuous screw flight extending radially and helically from and along the shaft and having a predetermined pitch. The screw flight has a plurality of portions which are cut out from the flight to form openings therein, with the cut out portions being bent at a predetermined angle with respect to the shaft. Also, but less preferred, is an arrangement where the pulp particle dispersing and advancing means comprises a ribbon blade extending radially and helically about the shaft and having a predetermined pitch. When a ribbon blade is used, an inclined ribbon having infinite pitch may be used.

For any embodiment except the infinite pitch ribbon, the pitch of the paddle blades or screw flight may be decreased at the same shaft RPM to obtain higher fill levels. This increases pulp residence time in the apparatus to thereby obtain increased conversion of the gaseous bleaching agent.

The pitch at the first end of the shaft can be higher than the pitch at the second end of the shaft to provide an increased conveying rate in the pulp entrance end of the shell, where the pulp has the lowest bulk density. Also, the pitch can be modified to reduce conveying efficiency, for more efficient contact of the pulp particles with the gaseous bleaching agent and increased conversion of the gaseous bleaching agent, while maintaining a substantially constant residence time of pulp particles therein.

Instead of paddle blades or screw flights, a series of wedge-shaped flights or elbow shaped lifters can be used, provided that they are spaced at a sufficient distance to minimize or avoid bridging or plugging of the pulp particles therebetween.

The pulp particle dispersing and advancing means of the apparatus, as for example the paddle conveyor, apparatus may also be adjusted to reduce the fill level of the pulp particles in the shell. This adjustment can be accomplished by providing a first conveyor section which has a higher conveying rate. This first conveyor section is operatively associated with a second conveyor section for dispersing the pulp particles in the gaseous bleaching agent. Advantageously, the first and second conveyor sections include conveying elements such as paddles on a common shaft at a distance sufficient to minimize or avoid bridging or plugging of the pulp particles therebetween. Also, means for controlling operating parameters of the first and second conveyor sections can be used to provide a desired reactor fill level, pulp particle residence time and/or bleaching agent residence time.

In a preferred arrangement, the shell has two sections, one mounted above the other and facing in opposite directions. The first (or upper) shell section includes the first and second conveyor sections through which the pulp advances to a conduit leading to the lower shell section where the pulp is further treated as it is advanced by a third conveyor section to the exit of the lower shell section. This arrangement conserves plant space.

Gas flow through the apparatus may be cocurrent (same direction) or countercurrent to the advancing pulp, although countercurrent gas flow is preferred. Further, the means for introducing the gaseous bleaching agent into the shell can be located at a single position which introduces the gaseous bleaching agent cocurrently or countercurrently to the advancing pulp at one or multiple locations.

A dilution tank may be used for receiving the bleached pulp and residual gaseous bleaching agent. The apparatus further includes means for recovering the residual gaseous bleaching agent and means for recovering the bleached pulp. The means for recovering bleached pulp comprises a first outlet located in a lower portion of the dilution tank and, for cocurrent gas flow, the means for recovering the residual gaseous bleaching agent comprises a second outlet located at an upper portion of the dilution tank.

A particularly useful component of the present apparatus includes means for comminuting the pulp particles. Such means is operatively associated with the means for introducing the pulp particles into the shell.

DETAILED DESCRIPTION OF THE INVENTION

Figure 1:
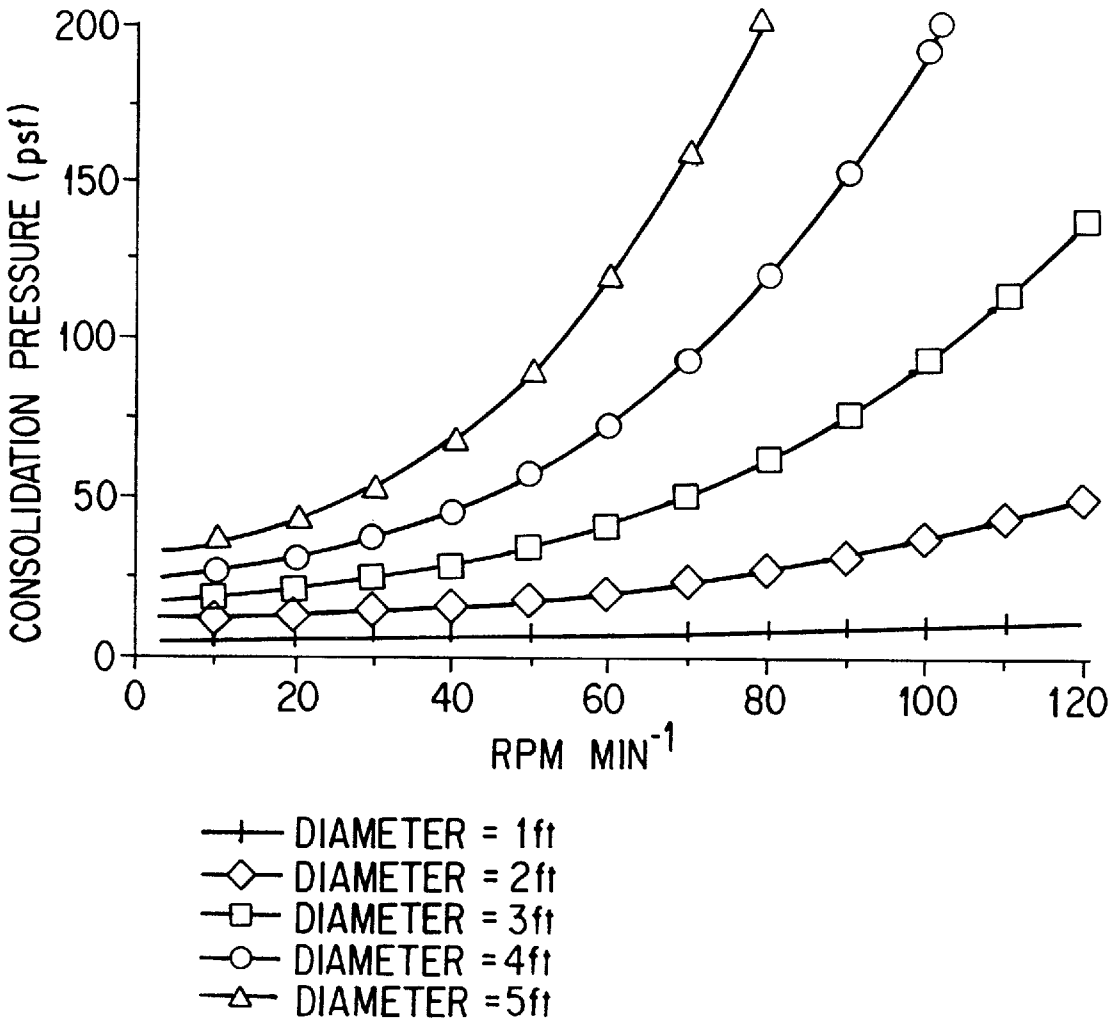
FIG. 1 is a graph of shaft RPM vs. pulp consolidation pressure for different diameter pulp conveyors.

The reactor of the present invention utilizes a gaseous bleaching agent such as ozone, while minimizing the degree of attack upon the cellulosic portion of the wood, thus forming a product having acceptable strength properties for the manufacture of papers and various paper products. Before describing the details of the reactor apparatus, it is beneficial to have an understanding of the underlying delignifying and bleaching process in which the apparatus is employed.

The ozone gas which is used in the bleaching process may be employed as a mixture of ozone with oxygen and/or an inert gas, or as a mixture of ozone with air. The amount of ozone which can satisfactorily be incorporated into the treatment gases is limited by the stability of the ozone in the gas mixture. Ozone gas mixtures which typically, but not necessarily, contain about 1–8% by weight of ozone/oxygen mixture, or 1–4% by weight of ozone/air mixture, are suitable for use in this invention. A preferred mixture is 6% ozone with the balance predominantly oxygen. The higher concentration of ozone in the ozone/oxygen mixture allows for the use of relatively smaller size reactors and a shorter reaction time to treat equivalent amounts of pulp, thereby lessening the capital cost required for the equipment.

A further controlling factor for the bleaching of the pulp is the relative weight of the ozone used to bleach a given weight of the pulp. This amount is determined, at least in part, by the amount of lignin which is to be removed during the ozone bleaching process, balanced against the relative amount of degradation of the cellulose which can be tolerated during ozone bleaching. Preferably, an amount of ozone is used which will react with about 50% to 70% of the lignin present in the pulp.

There are many methods of measuring the degree of delignification but most are variations of the permanganate test. The normal permanganate test provides a permanganate or "K No." which is the number of cubic centimeters of tenth normal potassium permanganate solution consumed by one gram of oven dried pulp under specified conditions. It is determined by TAPPI Standard Test T-214.

The entire amount of lignin, evidenced by the final K No., should be such that the ozone does not react excessively with the cellulose to substantially decrease the degree of polymerization of the cellulose. Preferably invention, the amount of ozone added, based on the oven dried weight of the pulp, typically is from about 0.2% to about 2% to reach the desired lignin levels. Higher amounts may be required if significant quantities of dissolved solids are present in the system. Since ozone is relatively expensive, it is advantageous and cost effective to utilize the smallest amounts necessary to obtain the desired bleaching.

The duration of the reaction used for the ozone bleaching step is determined by the desired degree of completion of the ozone bleaching reaction as indicated by complete or substantially complete consumption of the ozone which is utilized. This time will vary depending upon the concentration of the ozone in the ozone gas mixture, with relatively more concentrated ozone mixtures reacting more quickly, and the relative amount of lignin which it is desired to remove. The preferred residence times for pulp and gas are described in further detail below.

An important feature of the invention is that the pulp be bleached uniformly. This feature is obtained in part by the comminution of the pulp prior to the treatment with ozone into discrete pulp particles of a sufficient size and of a sufficiently low bulk density so that the ozone gas mixture will completely penetrate a majority of the fiber flocs.

A still further important feature of the invention is that during the ozone bleaching process the particles to be bleached should be exposed to the ozone bleaching mixture by mixing so as to allow approximately equal access of the ozone gas mixture to all flocs. The mixing of the pulp in the ozone gas mixture gives superior results with regard to uniformity as compared to the results obtained with a static or moving bed of pulp, wherein some of the pulp is isolated from the ozone gas relative to other pulp due to differences in bed height and bulk density at various positions within the bed. This causes non-uniform passage of the ozone-containing gas through the fiber bed which in turn results in non-uniform gas-pulp contact and non-uniform bleaching. The apparatus of the present invention has more ability to minimize pressure drop and is also more flexible in that it can readily be run with ozone gas moving cocurrently or countercurrently to the pulp compared to a bed reactor which uses only cocurrent movement.

In order to understand the unique features of the reactor of the present invention, one must be familiar with the terms and principles used in the conveying of solids utilizing screw conveyors. The concept of the pitch of such conveyors is well known to those skilled in the art (see, e.g., Colijn, H., "Mechanical Conveyors for Bulk Solids," Elsevier, N.Y., 1985).

For a closed flight screw conveyor, for example, the pitch is the distance measured from any point on a screw flight to the corresponding point on an adjacent screw flight, measured parallel to the shaft axis. (The corresponding point can be found by following the edge of the flight for 360° about the shaft). For a full pitch screw, the measured distance between these points is equal to the diameter of the screw flight.

A variation of the closed flight screw conveyor is one which uses discrete paddles which are positioned in spaced relation along the helical line that the closed flight screw conveyor would follow. Thus, in a paddle conveyor, the paddles replace screw flights, and the pitch is the distance from any point on a paddle to a corresponding point on an adjacent paddle measured parallel to the shaft axis. For certain paddle configurations, however, some of the paddles are removed, and in that situation the corresponding point is the point where the paddle would have been after a rotation of 360° when following a path along and between the edges of the paddles.

The terminology for designating paddle spacing includes an angular relationship and a spacing determined by pitch. For example, a 60° full pitch paddle configuration for an 18" diameter conveyor has the first six paddles spaced 3 inches apart along the axis of the shaft with each successive paddle placed 60° around the circumference of the shaft from the previous paddle. The paddle pattern then repeats over the next 18 inches. A 120° full pitch paddle configuration for the same 18" diameter conveyor has the first three paddles spaced 6 inches apart along the shaft axis with each successive paddle spaced 120° around the shaft circumference. The paddle pattern then repeats over the next 18 inches. A 120° half pitch paddle configuration for the same 18" diameter conveyor would have paddles spaced 3 inches apart along the shaft axis with each successive paddle spaced 120° around the shaft circumference. Again, there is a repetition of the paddle pattern which appears on the first 18" of paddle axial length.

The 240° paddle configuration requires additional discussion. As an example, a 240° quarter pitch paddle configuration for an 18" conveyor also has six paddles spaced three inches apart along the shaft axis, but now each successive paddle is placed 240° around the shaft circumference. For a subsequent 18" length of shaft, this pattern would repeat. By plotting a helical path along the edges of the paddles, one would find that four repeating helices are generated every 18 inches along the shaft by the six paddles: thus, the one-quarter pitch arrangement is confirmed, but only the first, fourth and seventh paddles are at a 12 o'clock (or 0 degree) position over the 18" shaft length.

There are numerous other variables which can be controlled in paddle conveyors. The paddle angle is the orientation of an individual paddle measured by a line projected down to the shaft from the face of the paddle with respect to a line parallel to the axis of the shaft. As one skilled in the conveying art would know, a paddle angle of 45° provides greatest axial forces (i.e. in the direction of the shaft axis) to the material to be conveyed. As this angle is decreased toward 0 or increased toward 90°, axial forces are decreased. At 0° and 90°, no axial forces are provided at all.

A distinct advantage of use of the paddle configuration as opposed to other alternative configurations, such as the ribbon mixer and the continuous screw with the bent openings on the flights, is that with the paddles there is the option of providing a unique and defined orientation of the paddle relative to the axis of rotation. By this is meant that the paddles may be attached to the shaft at specific points along the axis of rotation. Further the paddle angle defined above can be arranged such that the paddles can be specifically oriented to provide either a forward or backward motion of the material being processed through the reactor. This has the advantage that in the use of the apparatus, the paddles can be oriented as required to provide a given amount of reaction in a given portion of the reactor or to either retard or advance the material being processed. A further advantage of the paddles is that the individual paddles can be readily adjusted to provide changes with regard to operating conditions between different types of woods or different processing conditions as opposed to the continuous screw, and the like, which might require replacement of the entire unit.

The paddle size and shape are additional variables. The physical dimensions of particular flat paddles for use in various diameter paddle conveyors have been standardized by the Conveyor Equipment Manufacturer's Association ("CEMA") in,their bulletin ANSI/CEMA 300-1981 entitled "Screw Conveyor Dimensional Standards". This bulletin may be referred to for specific dimensional details and alternate conveying element configurations. Also, other shapes such as cupped, curved or angled paddle designs can be adopted depending upon the desired bleaching results.

Finally, paddle conveyors have-a certain "hand" which, in conjunction with the direction of rotation of the shaft determines an axial direction of flow of the material to be conveyed. A "left hand" configuration on a shaft which is rotated in a clockwise direction, when viewed from the end of the shaft, conveys material away from the viewer, while a "right hand" configuration rotated clockwise conveys material toward the viewer. For counterclockwise rotation, the material is conveyed oppositely: the flow direction is reversed by reversing the direction of rotation.

While the preferred mode of operation of the apparatus of the present invention utilizes a vessel fill level of about 10 to 50 and preferably about 15 to 40 percent, image analysis techniques have shown that the majority of the pulp fibers placed in the reactor of the present invention are suspended in the gas phase. This is in contrast to the fibers being moved along the bottom of the conveying tube as would normally be expected when using a closed flight continuous screw conveyor.

"Fill level" as used herein refers to the amount of pulp in the open spaces of the reactor by volume. For example, a fill level of 25% indicates that 25% of the open spaces of the reactor are filled with pulp, based on the bulk density of the pulp when it is at rest, the amount of pulp in the reactor, and the reactor volume. For any particular conveyor design, pulp feed and shaft RPM, a particular fill level is obtained. By varying RPM at constant pulp feed rate, the fill level can be changed. If the RPMs are increased, the fill level is reduced correspondingly. For the present invention, the fill level must be sufficient to enable a significant proportion of pulp to be dispersed. This generally requires a fill level of above 10%. Similarly, the fill level is preferably less than about 50% so as to provide sufficient open space into which the pulp can be dispersed. Advantageous fill levels range from about 15 to 40%. Fill as high as about 75% can be used, but at reduced gas/pulp contacting efficiencies.

The reactor of the present invention is constructed in such a manner as to minimize the axial dispersion of the fibers as they are conveyed forward. Conventional art teaches away from the use of a paddle conveyor comprising smaller-than-CEMA standard size paddles mounted in a non-overlapping paddle configuration. Prior art would predict large unswept areas or dead zones in the reactor, resulting in a broad pulp residence time distribution with nonuniform bleached pulp as a result. Conventional art would also teach that suspending the fiber would cause a portion of the fiber to fall over the conveyor center shaft, in which case the fiber would not convey forward as efficiently, again causing a broad axial dispersion of the fiber. The preferred paddle design of the present invention unexpectedly results in a narrow axial dispersion of the fiber. The preferred paddle design suspends the fiber by imparting sufficient momentum to convey it forward while causing radial motion to suspend the fiber in the gas phase. This same phenomenon also forces the fibers in the dead zones to move forward as well with the end result being only a small degree of axial dispersion of the fibers as they move forward. This small degree of dispersion is equivalent to a narrow fiber residence time distribution, which results in uniform bleaching. These features allow the pulp particles to be substantially uniformly delignified and bleached to the desired lignin content, viscosity, and brightness.

A preferred conveyor is one having paddles positioned at 240° spacings in a helical quarter-pitch pattern along the length of the shaft, with each paddle positioned at an approximately 45° angle to the axis of the shaft. In a 19-inch conveyor reactor, with incoming high consistency pulp as described above, the conveyor length is such that the residence time for the pulp is approximately 60 seconds for shaft speeds of about 75 RPM while the gas residence time is about 50 seconds.

A variety of pitches can be used for the paddle, cut and folded flights and other types of conveyors. A quarter pitch has been found to be preferred for the reactor of the present invention although it is possible to use other degrees of pitch for particular applications.

The CEMA standard sets forth certain paddle blade sizes for given diameters. In this invention those sizes will be referred to as "standard" size. To achieve high pulp/gas contact, large paddles having an area of twice the standard size can be used. However, such large paddles also increase the conveying rate significantly. For increased mixing effects, small paddles having an area of about half that of a standard paddle, can be used.

The paddle angle can also be varied as desired. While a 45° angle is preferred for maximum axial movement, other angles can be used to increase the residence time of the pulp in the reactor.

The paddle spacing is important to avoid bridging of the pulp as it travels through the reactor, since bridging detracts from obtaining uniform pulp bleaching. Bridging (i.e., the forward movement of pulp in large clumps or masses which have arched between successive paddles) is caused by compaction and consolidation forces exerted on the pulp which increase pulp density and the ability of the pulp to adhere to itself.

For any particular conveyor design, one skilled in the art can calculate the estimated consolidation forces or stresses on the pulp from the operating characteristics of the conveyor utilizing the inertial force from the centrifugal movement of the paddles and the static head from the weight of the pulp therein. The consolidation pressures for standard paddle conveyors of different diameters when operated at a fill level of about 25% and at various RPMs are illustrated in FIG. 1. For example, a 2' diameter paddle reactor operated at 60 RPM would generate an estimated consolidation pressure of about 35 psi.

Figure 2:
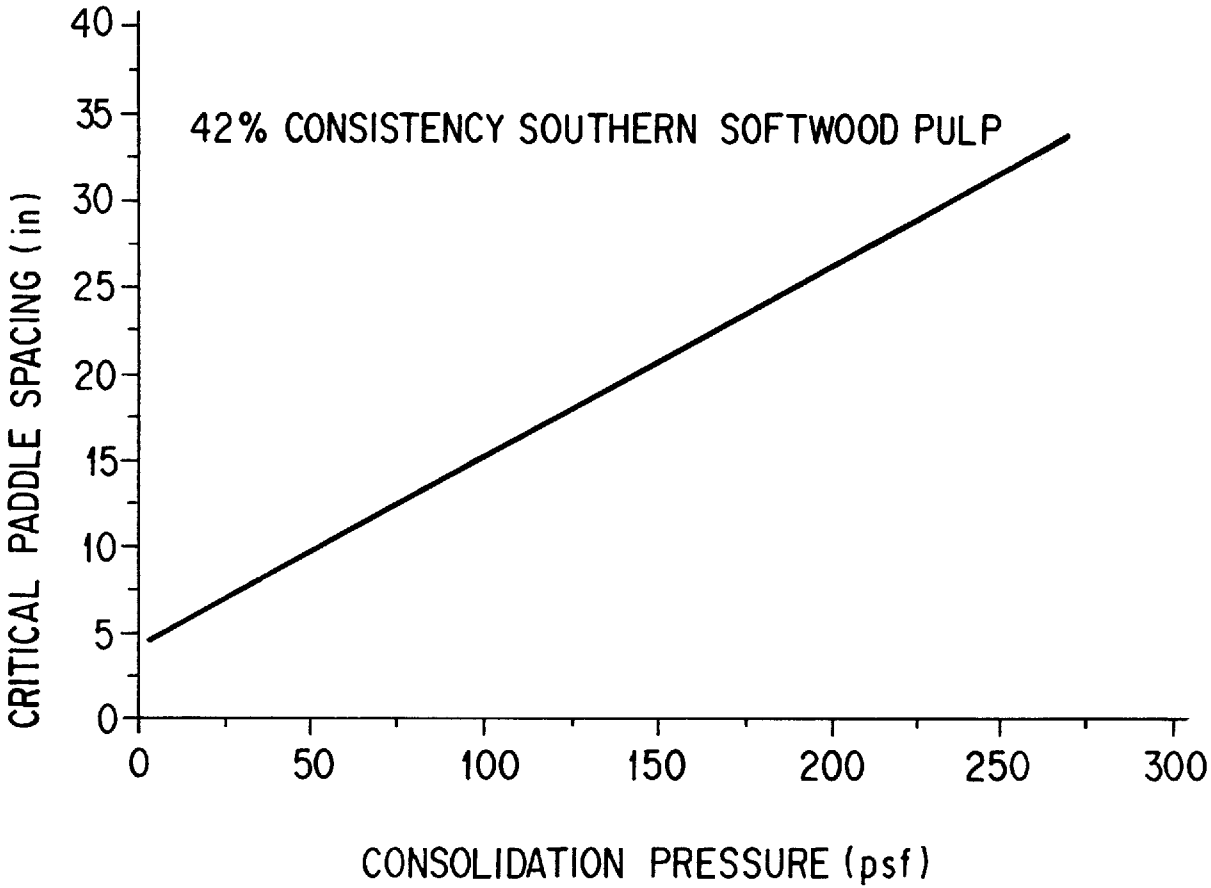
FIG. 2 is a graph of pulp consolidation pressure vs. critical paddle spacing for a 42% consistency southern softwood pulp.

For the particular pulp to be bleached, one can measure pulp strength versus consolidation pressure and then estimate how far apart the paddles must be to prevent bridging (i.e., the length beyond which the pulp cannot support its weight and will break into smaller segments). For 42% consistency southern softwood pulp, FIG. 2 illustrates a graphical representation of calculated critical (minimum) paddle spacing vs. consolidation pressure. For the particular example, a consolidation force of 35 psi suggests a minimum paddle spacing of about 6 inches.

Paddle spacing is determined by measuring a straight line distance between the two closest points of adjacent paddle edges. For a 240° quarter pitch paddle conveyor, the two closest points are the trailing edge of the first paddle and the leading edge of the fourth paddle. For other configurations, such as 60° full pitch, the two closest points would be the trailing edge of the first paddle and the leading edge of the second paddle. For any particular paddle configuration, this distance must be greater than the critical arching dimension of the pulp to avoid bridging.

The ozone gas can be introduced at any position through the outer wall of the shell of the reactor. The paddles can also assist in inducing the flow of ozone gas in a radial direction, thus improving mass transfer.

At low RPMs, the paddles move the pulp in a manner such that it appears to be "rolling" or "lifted and dropped" through the reactor. At higher RPMs, the pulp is dispersed into the gas phase in the reactor, with the pulp particles uniformly separated and distributed throughout the gas, causing uniform bleaching of the pulp. Thus, the presently preferred paddle conveyor achieves the objectives of the present bleaching process, namely:

(1) High tonnages of pulp can be conveyed through the reactor without substantial compaction, bridging or plugging of the pulp while the pulp is advanced in a nearly plug flow manner, at fill levels high enough to result in acceptable pulp-gas contact, (2) Substantially all of the pulp particles are uniformly bleached by the time they leave the reactor, and (3) A high amount (greater than 75 and preferably greater than 90%) of the ozone is consumed by the time it exits the reactor.

Another factor which is important in ozone bleaching reactor design is achievement of uniform bleaching of the pulp particles with the gaseous bleaching agent, via control of the residence time distribution of the pulp in the reactor. The pulp residence time distribution in the reactor should be as narrow as possible, i.e., the pulp should ideally travel through the reactor in a plug-flow like manner. If some pulp particles travel too rapidly through the reactor, they will be underbleached, while those that move too slowly become overbleached.

As noted above, the paddle conveyor allows the pulp to be efficiently contacted and mixed with the gas. It was unexpectedly found that increasing the RPMs of these relatively inefficient conveyors enabled the dispersed pulp to travel through the reactor in a plug-flow like manner. This dispersed plug-flow movement enables the pulp to achieve the desired narrow residence time distribution in the reactor.

To determine the pulp residence time for a particular conveyor, an indicator technique has been developed using lithium salts. Since lithium generally is not present in the partially delignified pulp which is to be bleached with ozone in the reactor of the invention, this technique includes adding a lithium salt, such as lithium sulfate or lithium chloride, as a tracer into the pulp entering the reactor at a particular time, sampling the pulp exiting the reactor at predetermined time intervals after the lithium salt has been added, measuring the amount of lithium in each sample, and graphically depicting the lithium concentration vs. time.

Figure 3:
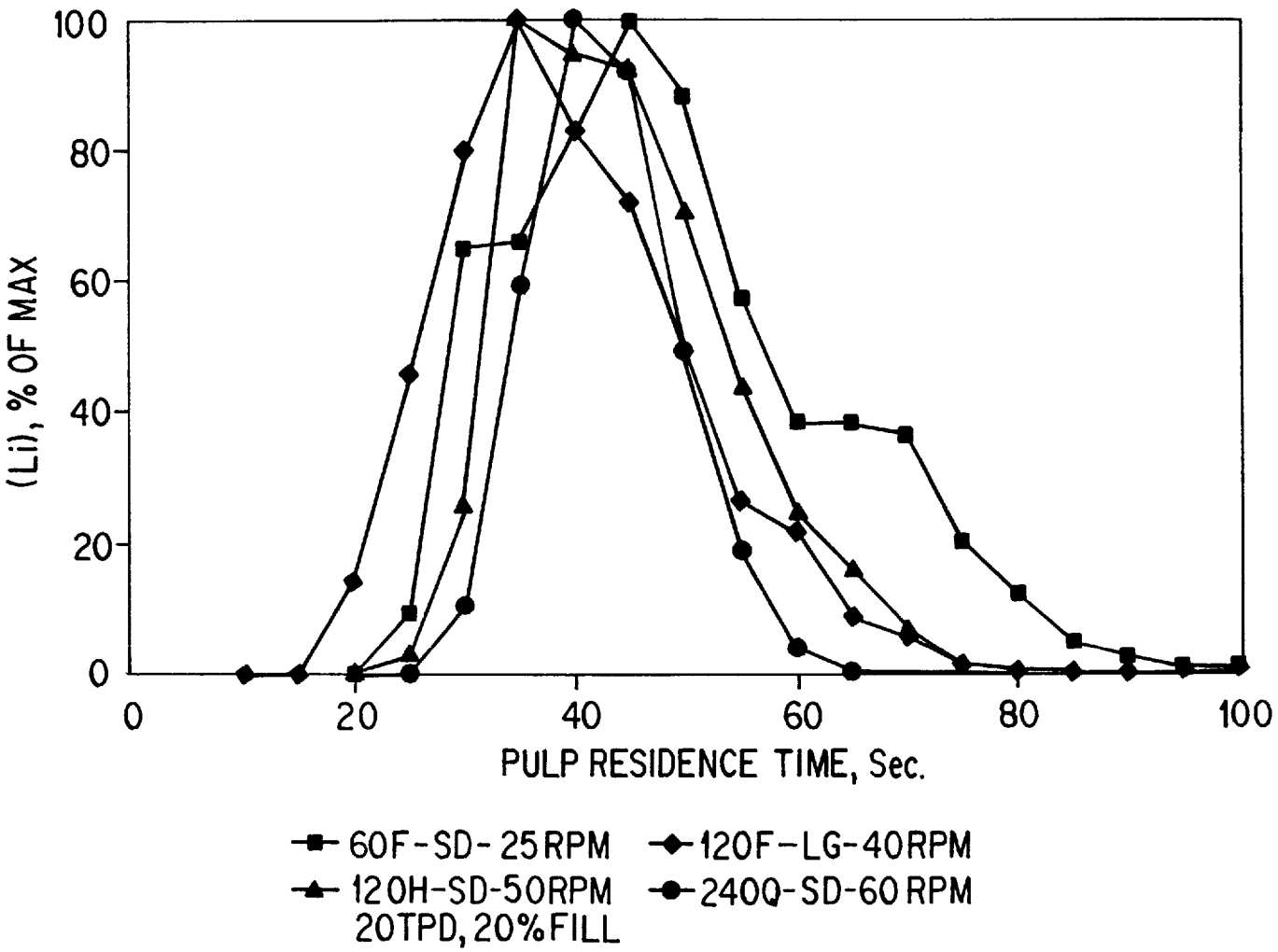
FIG. 3 is a graph of lithium concentration of pulp exiting the reactor vs. time after lithium-treated pulp is added at the reactor entrance as an indicator to determine the residence time of the pulp in the reactor for certain paddle conveyors.

FIG. 3 illustrates the residence time distribution for five different paddle conveyors in a 19.5" internal diameter reactor shell where a small amount of lithium-treated pulp is added at the reactor pulp entrance and the samples are taken from the reactor pulp exit at regular time-intervals thereafter. The reactor was operated at a 20% fill level for each conveyor configuration and at a 20 ton per day pulp feed rate. The curves show that the conveyors which are less efficient conveyors, requiring operation at higher RPM to maintain a desired fill level, provide a narrower pulp residence time distribution which is closer to actual plug flow. This control over the pulp residence time distribution contributes to the uniformity of bleaching of the pulp.

A shorthand notation is used to designate the various paddle configurations: the first number is the angular spacing of the paddles; this number is followed by the letter, F, H, or Q which stand for full pitch, half pitch or quarter pitch paddle arrangements, respectively. Next, two letters indicate the paddle size: SD-Standard size (i.e., CEMA standard for full pitch conveyors); LG-large (2× standard) size; SM-small (½ standard) size. The last number is the shaft RPM, and each paddle angle with respect to the shaft is 45° unless otherwise designated. Thus, 240 Q-SM-90 RPM, for example, designates 240° quarter pitch small size paddles on a shaft rotated at 90 RPM. 240 Q-SM-90 RPM 25° is the same design except that the paddle angle is 25° rather than 45°.

In an ideal plug flow reactor, all of the material flowing through the reactor has the same residence time, i.e., it spends the same amount of time in the reactor before emerging at the other end. In reality, this result cannot be obtained exactly. Instead, some material will spend more time in the reactor than other material, being overbleached relative to the average amount, while other pulp with a short residence time will be underbleached relative to the average.

The pulp residence time distribution ("RTD") can be measured using the lithium indicator technique described above in which a small amount of the pulp is treated with a lithium salt tracer. The pulp is then added all at once to the reactor entrance at time zero (t=0). The concentration of lithium in the pulp is then monitored at the reactor exit by taking discrete pulp samples and measuring the lithium concentration. If the lithium concentration is monitored continuously, a continuous RTD could be obtained.

The following definitions are taken from Levenspiel, O., *The Chemical Reactor Omnibook*, OSU Book Stores, Inc., January 1989 (ISBN: 0-88246-164-8). The average pulp residence time is:

$$t_{avg} = \frac{\int_o^\infty C_T t\,dt}{\int_o^\infty C_T\,dt}$$

if the tracer concentration, $C_\tau$ is obtained in continuous fashion, whereas if $C_\tau$ is in discrete form, $t_{avg}$ can be approximated by:

$$t_{avg} = \frac{\sum_{i=1}^{n} C_{T,i} t_i \Delta t_i}{\sum_{i=1}^{n} C_{T,i} \Delta t_i}$$

where n samples were obtained for the residence time distribution. The variance, $\sigma^2$, of the residence time distribution is a measure of how wide it is. This is given as:

$$\sigma^2 = \frac{\int_o^\infty C_T t^2\,dt}{\int_o^\infty C_T\,dt} - (t_{avg})^2$$

and can be approximated for discrete distribution as:

$$\sigma^2 = \frac{\sum_{i=1}^{n} C_{T,i} t_i^2 \Delta t_i}{\sum_{i=1}^{n} C_{T,i} \Delta t_i} - (t_{avg})^2$$

For a perfect plug flow vessel, the variance would be zero. The larger the variance, the wider the pulp residence time distribution, and hence the more axial mixing there is. Further, a wider residence time distribution will lead to less uniform bleaching, with some fibers overbleached and some underbleached. This can compromise bleached pulp quality and may consume excess bleach chemical. Thus, the variance can be used as a measure of bleaching uniformity, with a small number being preferred.

In order to compare bleaching uniformity between experiments having different average residence times, it is necessary to normalize the variance. The dispersion index ("DI") is defined as follows:

$$DI = \frac{100\sigma^2}{(t_{avg})^2} = 100\left[\frac{\int_o^\infty C_T t^2\,dt}{\int_o^\infty C_T t\,dt} - 1\right]$$

for continuously measured residence time distributions, which can be approximated as:

$$DI = \frac{100\sigma^2}{(t_{avg})^2} = 100\left[\frac{\sum_{i=1}^{n} C_{T,i} t_i^2 \Delta t_i}{\sum_{i=1}^{n} C_{T,i} t_i \Delta t_i} - 1\right]$$

for discrete distributions. The dispersion index is proportional to the variance. This normalized variance, which measures deviation from plug flow and hence is a measure of axial dispersion, will be used as an indicator of bleaching uniformity. A value of zero would indicate perfect plug flow. Large values indicate poor bleaching uniformity.

Figure 4:
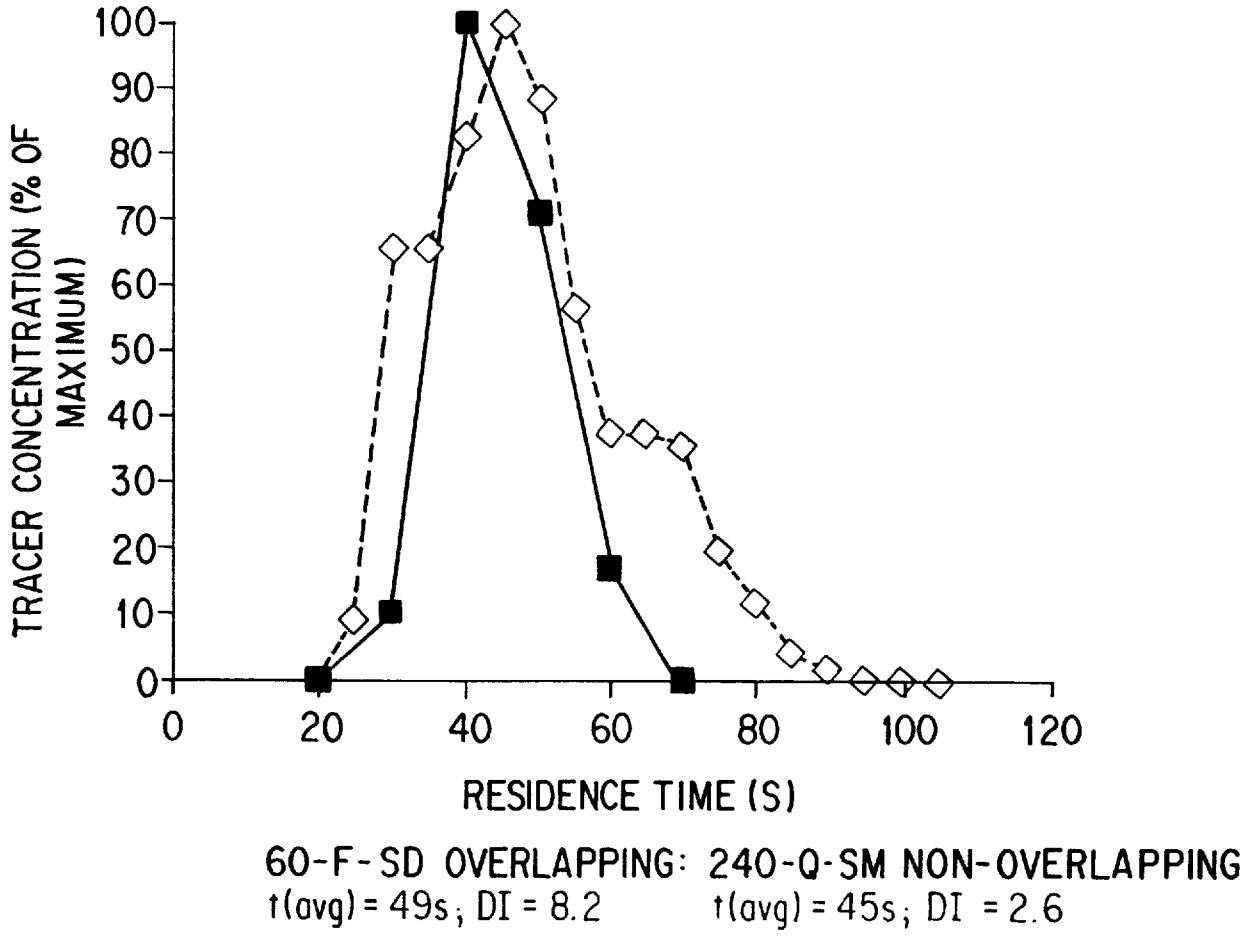
FIG. 4 is a graph of relatively wide and narrow pulp residence time distributions for certain paddle conveyors.

To illustrate the concept, consider FIG. 4 in which the experimentally determined pulp residence time distribution is plotted for two different paddles designs: 60 degrees full pitch with overlapping paddles, and 240 degree quarter pitch with non-overlapping paddles. In each case the pulp production rate was about 20 tpd. The paddle shaft rotation speeds were 25 and 90 rpm, respectively. Note especially that, although the average residence times were about the same (49 and 45 seconds, respectively), the width of the distributions are very different.

In the first case (60 degree design), about 10% of the pulp has a residence time less than 32 seconds while another 10% has a residence time greater than 71 seconds. For the second case (240 degree design), the corresponding range is 36 seconds and 55 seconds. The wider range is indicated by the higher dispersion index, 8.2 vs. 2.6. The pulp with the shortest residence time will be underbleached and that with the highest will be overbleached, relative to the average amount of bleaching. This effect would be larger for the case with the higher dispersion index.

Comparison can also be made with closed flight screws conveyors. Closed flight screws, while providing close to plug flow with low DI values, do not disperse the pulp into the gas. It is not enough to obtain plug flow unless the pulp is also dispersed, since plug flow of nondispersed pulp also results in non-uniform bleaching. As noted above, the pulp in the paddle conveyor is lifted and tossed in the reactor to maximize the rate and efficiency of the bleaching process, due to the increased amount of surface area of the pulp fibers exposed to ozone.

It has also been found that utilizing a cut and folded screw flight design obtains results somewhat similar to those obtainable through the use of a paddle conveyor. A typical cut-and-folded screw flight design is shown at 52 in FIG. 17. The open portions 54 of the flight 56 permit the gas to be directed therethrough while the folded portions 58 cause both radial distribution of the gas and the appropriate lifting, tossing, displacement and dispersion of the pulp in the gas as the pulp is advanced to obtain the desired uniform bleaching. Thus, by correctly tailoring the reactor length, screw pitch, screw rotation speed and design, a relatively short gas and pulp residence time with uniform exposure of the pulp to the gas is achieved, the result of which is a highly uniform bleached pulp.

The overall efficiency of this apparatus for bleaching is basically controlled by development of an internal paddle configuration that runs counter to conventional conveying art. As noted above, the conventional paddle design for conveying has been specifically developed to enhance conveying efficiency, whereas in the present invention, the design is intended to substantially reduce conveying efficiency. Such a reduction of conveying efficiency, however, allows improved control of pulp residence time, the quantity of pulp available for contact, and the energy utilization necessary to achieve appropriate gas and pulp mixing. The lower conveying efficiency allows for relatively high rotational speeds of the paddles, thus increasing the dispersion and suspension of the pulp in the gas phase while retaining a relatively long pulp residence in the reactor for contact with the ozone.

Figure 5:
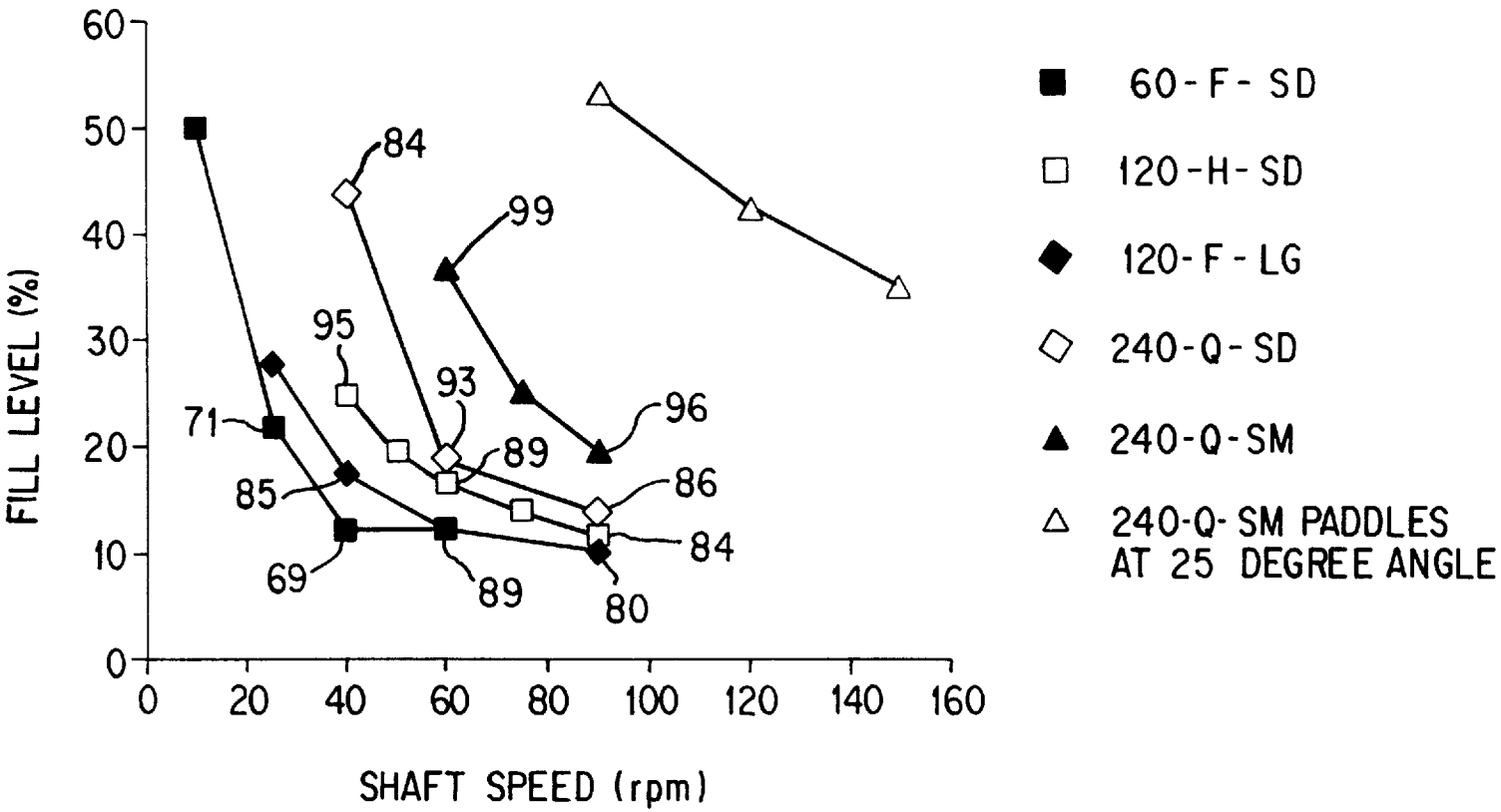
FIG. 5 is a graph of reactor fill level vs. shaft speed for different paddle conveyors.
Figure 6:
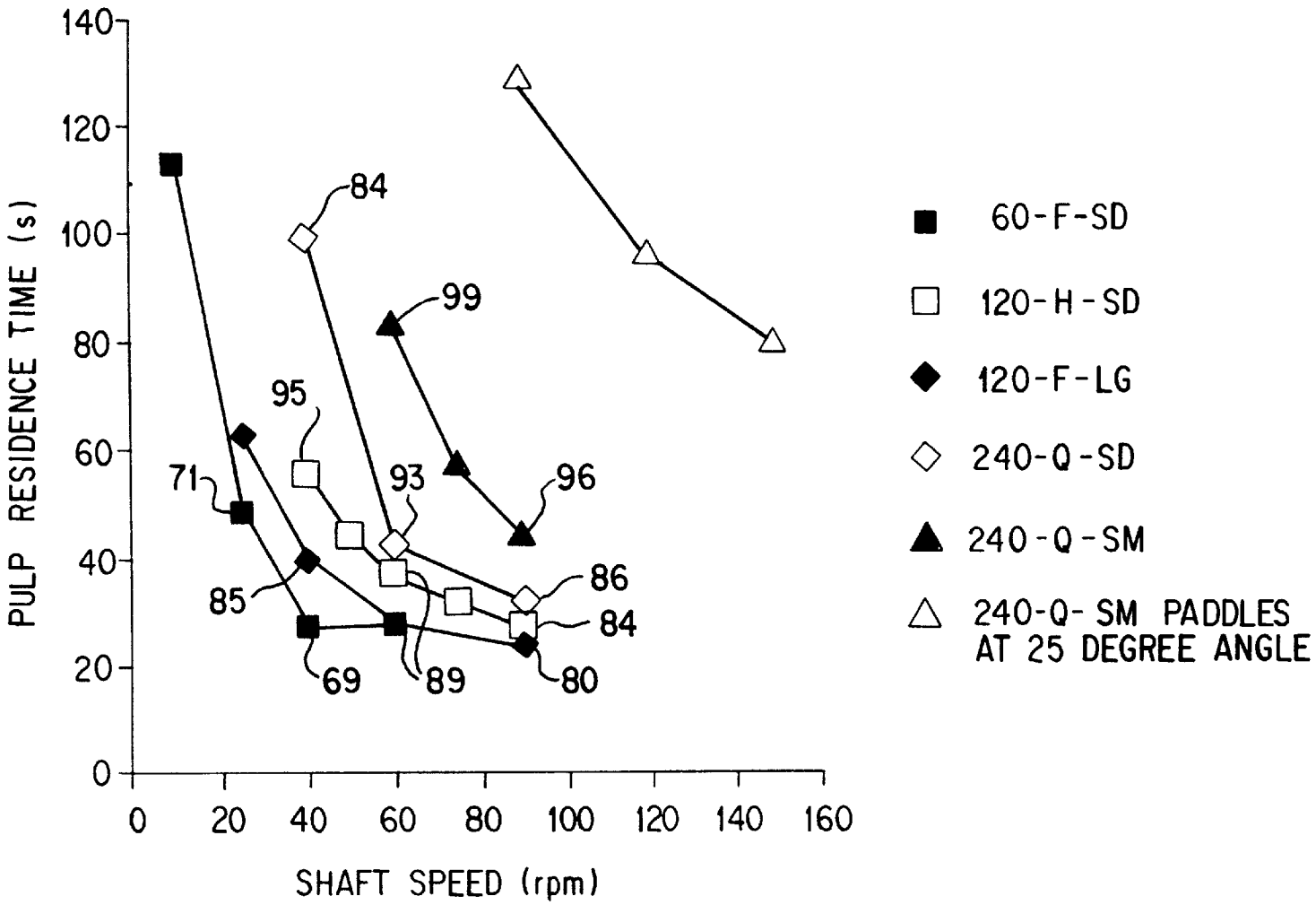
FIG. 6 is a graph of pulp residence times vs. shaft speed for different paddle conveyors.

To illustrate the effects on fill level and pulp residence time by varying the paddle design, FIGS. 5 and 6 are presented. For these conveyors, the pulp feed was 20 oven dry tons per day (ODTPD), the paddle angle to the shaft was 45° unless otherwise designated, and a 6% ozone/oxygen mixture at 35 SCFM was again utilized. The gas residence time was about 60 seconds. The pulp had a consistency of about 42% so that the ozone application is 1% on O.D. pulp. The data suggests that fill levels between about 20 and 40% at a shaft speed of 40 to 90 RPM and a pulp residence time of about 40 to 90 seconds is preferred when an ozone application of about 1% on oven dry pulp is utilized. In addition, these graphs show how a change in shaft RPM can affect fill level, pulp residence time and ozone conversion. In the invention, a gas residence time of at least about 50% or more of the residence of the pulp is useful, with at least about 67% being preferred.

In FIGS. 5 and 6, percent ozone conversion is indicated by a numerical value associated with certain data points on the graphs. These numerical values are also listed in Table IX of Example 10, along with the respective paddle design and reactor operating conditions.

These data suggest that higher fill levels can be achieved by reducing the pitch of the conveyor, utilizing smaller paddles, or using a flatter paddle angle. In particular, dramatic reductions in conveying efficiencies are obtained by merely changing the paddle angle from 45° to 25°. To compensate, much higher shaft RPMs are needed to retain fill levels.

The lower pitch and smaller paddle conveyors are operated at higher shaft RPMs while maintaining the desired fill levels of 20 to 40% without causing bridging or plugging of the pulp. Also, ozone gas conversions in the range of 90 to 99% are achieved, thus efficiently consuming the ozone and reducing the costs for generating same.

From this data, one skilled in the art can select both the optimum paddle design to achieve the desired residence times and fill levels, as well as how to adjust the RPM to control the fill rate for any pulp feed rate. For example, decreasing shaft RPM at constant feed increases residence time and fill levels. This design thus allows the operators to adjust the conveyor performance in response to changes in pulp feed properties, production rate, or other operating conditions.

Although the reactor of the invention can be utilized to bleach a wide variety of different pulps, a desirable range of initial pulp properties entering the reactor for softwood or hardwood pulp would be a K No. of 10 or less, a viscosity of greater than about 13 cps and a consistency of above 25% but less than 60%. Prior to entering the reactor, the pulp particles may be conditioned by acidification and/or the addition of metal chelating agents to increase the efficiency of ozone consumption by the pulp. After bleaching the pulp as described herein, the pulp exiting the ozone reactor has a GE brightness of at least about 45 percent and generally about 45 to 70 percent, with softwoods usually being above 45 and hardwoods usually being above 55 percent. The pulp (for hardwoods or softwoods) also has a viscosity of greater than about 10 and a K No. of 5 or less, and generally between about 3 and 4.

Figure 7:
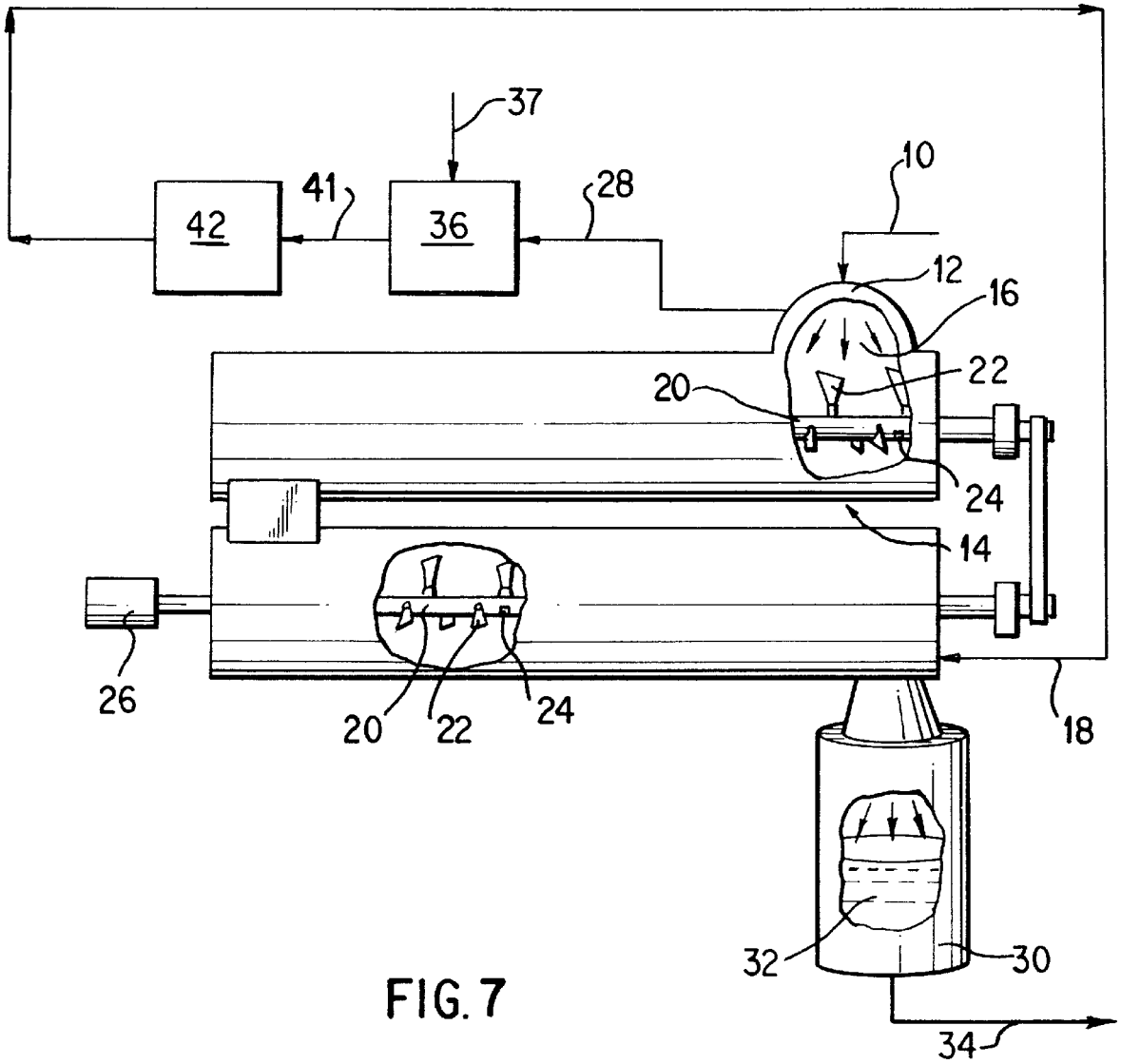
FIG. 7 is a side view of a preferred ozone reactor in accordance with the invention.

An apparatus in accordance with the present invention is schematically illustrated in FIG. 7. Prior to entering the apparatus, the pulp is directed into a mixing chest where it is conditioned by treatment with acid and a chelating agent. The acidified, chelated low-consistency pulp is introduced into a thickening unit for removing excess liquid from the pulp, such as a twin roll press wherein the consistency of the pulp is raised to the desired level. At least a portion of this excess liquid may be recycled to the mixing chest.

The resulting high consistency pulp is then passed through a screw feeder which acts as a gas seal for the ozone gas at one end of the reactor and thereafter through a comminuting unit, such as a fluffer, where the pulp is comminuted to pulp fiber flocs of a sufficient size which preferably measure about 10 mm or less in size. The comminuted particles are then introduced into a dynamic ozone reaction chamber which includes a conveyor and which is specifically designed for mixing and transporting the pulp particles so as to allow the entire surface of the particles to become exposed to the ozone gas mixture during movement of the pulp. After the ozone bleaching treatment, the pulp fiber flocs are allowed to fall from the reactor into a dilution tank.

As shown in FIG. 7, high consistency pulp 10 is directed into a comminuting device, such as a fluffer 12, which is mounted at one end of ozone reactor 14. Fluffer 12 comminutes the incoming high consistency pulp to pulp fiber particles 16 which then fall into the reactor chamber. The ozone gas 18 is introduced into the reactor 14 in a manner such that it flows countercurrent to the pulp. The pulp fiber particles 16 are bleached by the ozone in reactor 14 typically to remove a substantial 5 portion, but not all, of the lignin therefrom. The pulp fiber particles 16 are intimately contacted and mixed with the ozone by use of paddle conveyor 20, which in a preferred embodiment includes a plurality of paddles 22 mounted on a shaft 24 which is rotated by motor 26.

Conveyor 20 advances the pulp fiber particles 16 while tossing and displacing them in a radial direction. Also, the ozone gas is induced by the paddles 22 to flow and surround the pulp fiber particles so that all surfaces of the particles are exposed to the ozone for substantially complete penetration thereby. The paddle conveyor advances the pulp fiber particles in a plug flow-like manner at a controlled pulp residence time. The ozone gas residence time is also controlled. These features allow the pulp fiber particles to be substantially uniformly delignified and bleached by the ozone.

In the countercurrent process configuration, special attention is also given to the design of the pulp fiber inlet/gas outlet section to efficiently separate the gas and fiber streams. In particular, gas velocities in the gas-pulp separation zone are maintained below the critical velocity which would entrain the pulp in the exiting gas stream.

Figure 8:
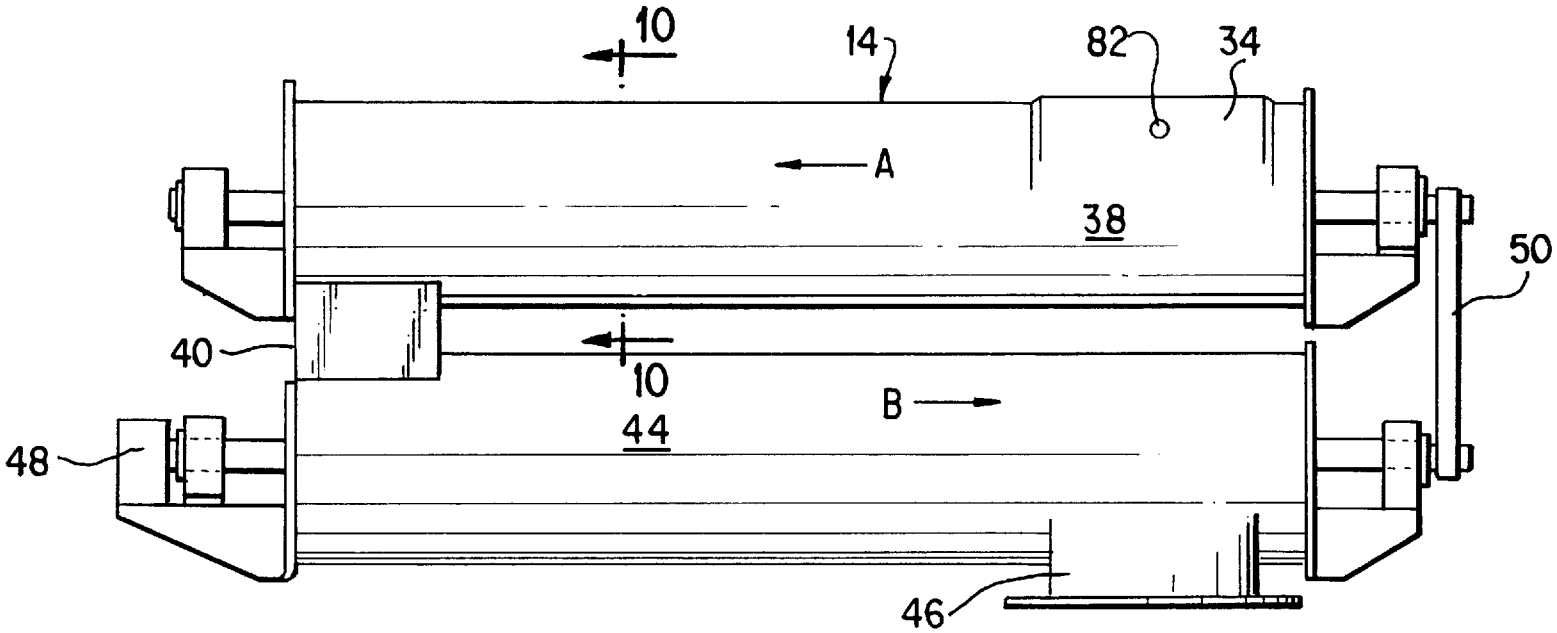
FIG. 8 is an enlarged side view of the reactor of FIG. 7.
Figure 9A:
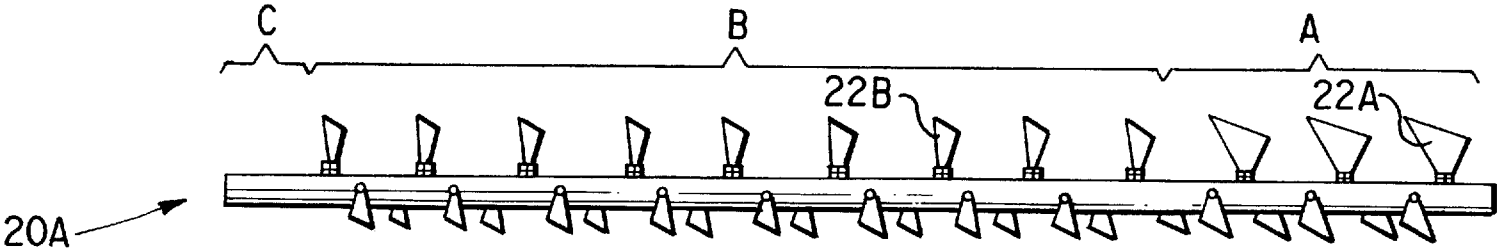
FIGS. 9A and 9B are views of the paddle conveyors for the reactor of FIG. 7.
Figure 9B:
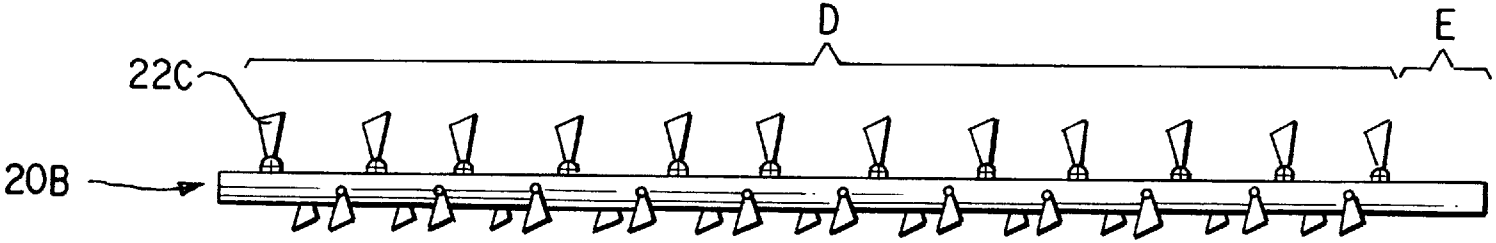

FIG. 8 is an enlarged external view of the reactor 14 of FIG. 7. FIGS. 9A and 9B show the conveyor sections of the paddle conveyor 20 which is disposed within the reactor. Pulp from the fluffer enters reactor 14 through pulp inlet 34, and falls onto paddle conveyor section 20A in upper shell 38. Conveyor section 20A has a right hand paddle design as described below. Pulp inlet 34 includes gaseous bleaching agent outlet 82 which allows the ozone/oxygen mixture to exit after contact with the pulp. The pulp moves in the direction of arrow A until it reaches the end of upper shell 38, at which time it drops through a conduit, in the form of a chute 40, and onto conveyor section 20B in lower shell 44. Conveyor section 20B has a left hand paddle design so that pulp travels in the direction of arrow B. At the end of lower shell 44, the pulp drops through outlet 46 and into the pulp dilution the upper portion of tank as shown in FIG. 7. In tank 30, high consistency pulp containing residual amounts of ozone is received. The residual ozone can continue to react with the pulp until it reaches a lower portion of the tank where dilution water 32, which serves as an ozone gas seal at the other end of the reactor, is added to reduce the consistency of the pulp to a low level to facilitate movement of the bleached pulp 34 through the subsequent process steps. The paddle conveyors sections 20A and 20B are driven by motor 48, which rotates the shaft of conveyor section 20B, which then transmits rotational force to the shaft of conveyor section 20A through drive coupling 50. Alternatively, separate drive motors can be used for each shaft.

The shaft for conveyor section 20A of upper shell 38 (shown in FIG. 9A) has three distinct zones: a first pulp feed zone (A) which is positioned beneath the pulp inlet 34, a second zone (B) which serves as a gaseous bleaching agent reaction zone, and a third pulp particle exit zone (C) which comprises a bare shaft with no paddles, positioned over chute 40. In some applications, zone A can have the same paddle configurations as zone B.

When the pulp enters upper shell 38, it is at its lowest bulk density after passing through the fluffer 12. Initial compaction occurs when this low density pulp encounters the feed zone paddles 22A. The first zone of the shaft thus has a higher conveying rate paddle configuration than the second zone in order to provide the desired pulp fill level. The pulp movement which is about twice as fast as that occurs in the gaseous bleaching agent reaction zone (B). For this purpose, zone (A) utilizes 120° half pitch standard size paddles 22A oriented at 45° to the shaft, while zone (B) 240° quarter pitch small (i.e., half) size paddles 22B, also oriented at 45° to the shaft. The paddles in sections A and B are fastened to the shaft of conveyor 20A in a "right-hand" configuration to convey the pulp toward pulp particle exit zone C by clockwise rotation of the shaft (as observed looking from the left side of FIG. 8).

After falling into lower shell 44, by way of the chute 40, the pulp is transported on the conveyor section 20B. The pulp is moved in a direction opposite to that resulting from the rotation of conveyor section 20A. This movement is produced since the paddles 22C on conveyor section 20B are configured in a "left-hand" arrangement, in contrast to the "right-hand" configuration of the paddles 22A and 22B on the conveyor section 20A. The paddles 22C of conveyor section 20B are also rotated in a clockwise direction (looking from the left side) in a manner similar to the paddles in upper shell 38. On conveyor section 20B, the pulp initially enters gaseous bleaching agent reaction zone D wherein it contacts paddles 22C. Paddles 22C are 240° quarter pitch small (i.e., half) size paddles, oriented at an angle of 45° to the shaft. This arrangement, as noted above, facilitates the reaction between the pulp and the ozone-containing bleaching agent. Zone E of conveyor section 20B, which lies directly above outlet 46, has no paddles for a specified length to permit the pulp to fall out of the reactor, through outlet 46 and into the dilution tank located directly below.

As noted above, a motor 48 and coupling 50 synchronously drives each shaft simultaneously.

Figure 10:
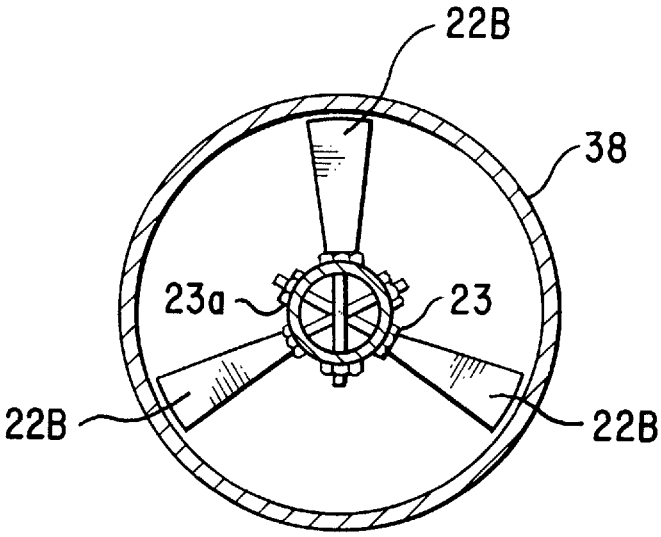
FIG. 10 is a cross-sectional view of the reactor of FIG. 8 taken along line 10—10.

FIG. 10 illustrates the paddle configuration found in the gaseous bleaching agent reaction zones (i.e., zones B and D) of, respectively, upper shell 38 and lower shell 44. As described above, paddles 22B and 22C have 240° quarter pitch, and are oriented at an angle of 45° to the shaft.

Figure 11:
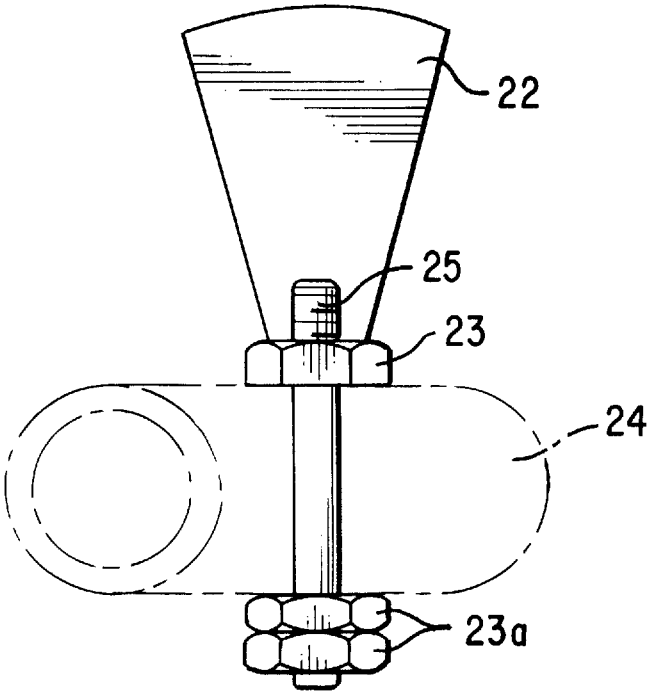
FIGS. 11 and 12 are perspective and side views of a typical paddle for use on the conveyor of FIGS. 9A and 9B.
Figure 12:
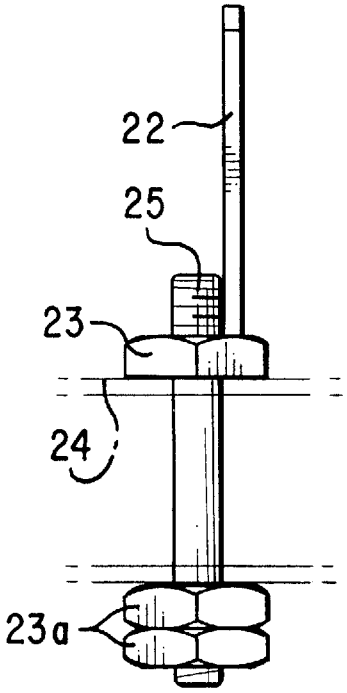

FIGS. 11 and 12 show the connection of all to shaft 24. Paddle blade 22 is welded or otherwise suitably attached to nut 23A. This combination is secured to shaft 24 by a threaded rod 25 passing through nuts 23*a* in conjunction with nut 23 to securely retain paddle blade 22 upon shaft 24 in the desired orientation. For the paddles shown in FIGS. 11–12, paddle blades 22 are positioned at the most preferred angle of 45° to the longitudinal axis of the shaft 24. Blades 22 may be positioned at any desired angle by loosening nuts 23*a*, rotating paddle 22, and re-tightening nuts 23*a*; thus allowing the conveyor paddles to be modified for particular applications. Instead of this bolting arrangement, the paddles can be directly welded to the shaft for more permanent conveying designs.

The blades include a surface having a width and length sufficient to pick-up, lift and disperse the pulp along the entire radius of the reactor. The surface is also configured and positioned to advance the pulp particles axially.

Figure 17:
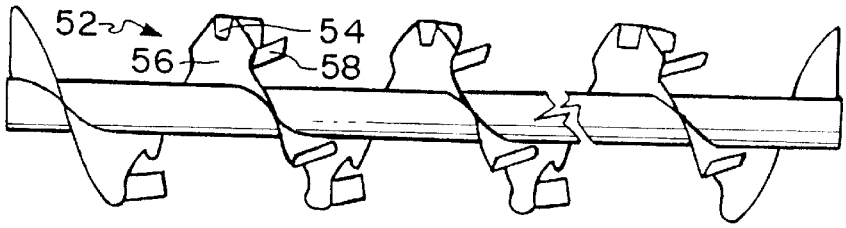
FIGS. 17–20 are views of different conveying elements for use in accordance with the invention.
Figure 18:
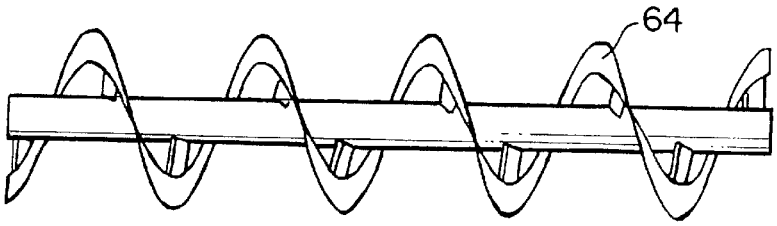
Figure 19:
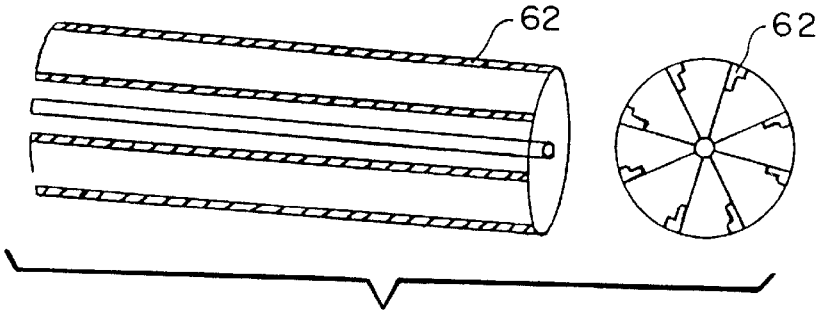
Figure 20:
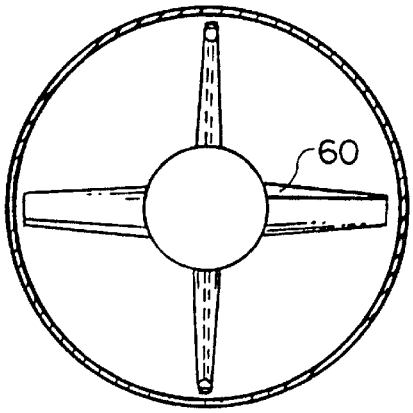

Although a paddle conveyor is preferred, other conveyor configurations can be used. A useful reactor can be made using a screw flight conveyor having so-called "cut and folded" flights, as shown in FIG. 17 discussed above. A series of wedge shaped flights 60 (shown in cross-section in FIG. 20) or elbow shaped lifter elements 62 (shown both in side view and cross-section in FIG. 19) are also useful for suspending the pulp in the gaseous bleaching agent. Ribbon mixers 64 may also be used (FIG. 18). An inclined reactor utilizing a totally flat ribbon flight, i.e., one having infinite pitch, with angles instead of flat blades, conveys the fiber particles with a similar lifting and dropping action to effect the desired gas-pulp contact and reaction. The inclined ribbon design results in plug-like flow advancement of the dispersed pulp with little backmixing, but this design cannot be adjusted as easily as the paddle conveyor. A combination of paddles and cut and folded flights can be used, if desired, in accordance with the foregoing. Typical, unmodified full screw flight conveyors are not acceptable, because they generally "push" the pulp therethrough, rather than toss and displace it as does the paddle conveyor. Thus, conventional screw flights do not provide sufficient mixing and contact of the pulp and ozone to achieve uniform bleaching of the pulp unless they are operated at extremely low fill levels (<10%) and at relatively high pulp residence times.

As discussed throughout this specification, the preferred gaseous bleaching agent is ozone. However, the principles of operation of this reactor can be utilized for the bleaching of pulp with other gaseous bleaching agents such as chlorine, chlorine dioxide, etc. While chlorine-containing bleaching agents are not preferred due to the generation of effluents containing relatively large amounts of chlorides and the potential environmental effects of chlorinated organics in such effluents, they can be successfully utilized as bleaching agents in the reactor of the invention. To avoid environmental concerns about pollution, ozone is the most preferred gaseous bleaching agent.

The ozone reactor is depicted as a horizontal, elongated shell in FIG. 7. If desired, however, the shell may be slightly angled with respect to horizontal to allow the force of gravity to assist in the advancement of the pulp particles. A typical "advancement angle" of up to 25 degrees may be used.

The reactor of FIG. 7 shows the pulp being treated with ozone countercurrently with the ozone-gas mixture. The pulp entering the reactor has the highest lignin content and initially contacts the exiting, nearly exhausted ozone mixture, thereby providing the optimum chance to consume virtually all of the ozone. This is an efficient method for stripping ozone from the ozone/oxygen or ozone/air mixture. Alternately, however, the portion of the pulp which has been bleached to the least extent may initially be contacted with the newly introduced ozone mixture containing the maximum amount of ozone by passing the ozone-containing gas in a direction cocurrent to the flow of pulp.

When the ozone 18 is contacted with the pulp in a countercurrent manner, the residual ozone gas 28 can be recovered as shown in FIG. 7. The residual ozone gas 28 from outlet 82 (FIG. 8) is directed to a carrier gas pretreatment stage 36 where a carrier gas 37 of oxygen (or air) is added. This mixture 40 is directed to ozone generator 42 where the appropriate amount of ozone is generated to obtain the desired concentration. The proper ozone/gas mixture 18, which as noted above preferably includes about 6 weight percent ozone, is then directed to ozone reactor 14 for delignification and bleaching of the pulp.

The bleached pulp after ozonation will have a reduced amount of lignin, and therefore, a lower K No. and an acceptable viscosity. The exact values for the K No. and the viscosity which are obtained are dependent upon the particular processing to which the pulp has been subjected. The resulting pulp will also be noticeably brighter than the starting pulp. For example, southern softwood will have a GE brightness of about 45 to 70%.

EXAMPLES

The scope of the invention is further described in connection with the following examples which are set forth for purposes of illustration only and which are not to be construed as limiting the scope of the invention in any manner. Unless otherwise indicated, all chemical percentages are calculated on the basis of the weight of oven dried (OD) fiber. Also, one skilled in the art would understand that the target brightness values do not need to be precisely achieved, as GEB values of plus or minus 2% from the target are acceptable. The feed pulp in these examples is fluffed oxygen bleached pulp having a K No. of about 10 or less, a viscosity of greater than about 13 cps, a consistency of about 42% and an entering brightness generally in the range of about 38–42% GEB.

This pulp is acidified to a pH of about 2 before being introduced into the reactor of the invention.

In Examples 1–10 and 13 that follow, the reactor was a 19.5" internal diameter, 20 foot long shell having conveying intervals therein as defined. Full pitch for this reactor is 19", and feed rate unless otherwise specified was generally about 20 tons per day of the 42% consistency partially bleached softwood pulp described above. Countercurrent ozone gas flow was utilized unless otherwise mentioned. The data in Examples 11 and 12 were obtained in a 17" conveyor.

Example 1

A cut and fold screw conveyor reactor, and one embodiment of a paddle type conveyor reactor of the present invention utilizing similar feed rates of pulp, rotational speed and gas residence time were compared. As is evidenced by the results illustrated in Table I, use of the paddle configuration resulted in an ozone conversion about 18 percent higher than that obtained with the conventional cut and fold screw conveyor reactor. The paddle reactor also exhibited an improved (i.e., lower) dispersion index, indicating a pulp movement closer to plug flow.

TABLE I

| Type of Conveyor | Feed Rate (ODTPD) | Conveyor Rotational Speed (RPM) | Ozone Appl. on Pulp (%) | Residence Time Gas (S) | Residence Time Pulp (S) | Fill Level (%) | Ozone Conversion (%) | Change in GE Brightness (%) | DI |
|---|---|---|---|---|---|---|---|---|---|
| Screw | 11 | 20 | 1.0 | 25 | 115 | 27 | 72 | 10 | 6.9 |
| Paddle | 11 | 30 | 0.9 | 33 | 169 | 40 | 90 | 12 | 1.9 |

Example 2

In a comparison between a conventional screw type conveyor reactor, and a paddle conveyor reactor, the paddle type conveyor configuration was specifically designed to achieve a lower conveying rate than the screw. This allowed the paddle conveyor to be run at significantly higher rotational speed, while maintaining a fill level equivalent to the screw. Table II illustrates that the significantly greater rotational speed of the paddle conveyor resulted in a 24 percent increase in ozone conversion in the paddle conveyor. Table II also illustrates how paddle configuration can be specifically designed to achieve excellent gas-fiber contacting in contrast to a conventional conveying configuration.

TABLE II

| Type of Conveyor | Feed Rate (ODTPD) | Conveyor Rotational Speed | Gas Flow Rate | Ozone Appl. on Pulp (%) | Residence Time Gas (S) | Residence Time Pulp (S) | Fill Level (%) | Ozone Conversion (%) | Change in GE Brightness (%) |
|---|---|---|---|---|---|---|---|---|---|
| Screw | 12 | 21 | 34 | 1.0 | 46 | 71 | 18 | 73 | 13 |
| Paddle | 18 | 90 | 35 | 0.9 | 46 | 45 | 18 | 97 | 15 |

Example 3

The design of the paddles on the paddle conveyor was altered in order to allow higher RPM operation while maintaining a constant fill level of 20 percent at a feed rate of about 18 to 20 oven dried tons per day, thereby keeping pulp residence time constant. The design alteration yielded a significant increase in ozone conversion as evidenced by Table III. As shown by this example, alteration of the full pitch conventional paddle arrangement as taught by this invention dramatically improves gas-fiber contacting by allowing reasonable fill level operation at higher RPM.

TABLE III

| Paddle Type: Paddle Spacing (deg) | Paddle Type: Pitch | Paddle Type: Paddle Size | Paddle Type: Paddle Angle (deg) | Feed Rate (ODTPD) | Paddle Rotational Speed (RPM) | Fill Level (%) | Res. Time Pulp (sec.) | Ozone Conversion @ 35 SCFM (%) | Change in GEB Brightness (%) |
|---|---|---|---|---|---|---|---|---|---|
| 60 | Full | Stnd | 45 | 20 | 25 | 21 | 49 | 71 | 12 |
| 120 | Half | Stnd | 45 | 20 | 50 | 19 | 44 | 92 | 15 |
| 240 | Quarter | Small | 45 | 18 | 90 | 18 | 45 | 97 | 15 |

Example 4

Pulp residence time distribution is considered a key indicator of bleaching uniformity. In one embodiment of the invention, paddle design was adjusted to result in a reactor with an improved, i.e., narrower pulp residence time distribution. The results illustrated in Table IV demonstrate that utilization of changed paddle design allows better mixing at higher RPM at a constant fill level with significant improvement in the Dispersion Index (DI). A DI of 0 is a perfectly non-dispersed plug flow while higher index values indicate the pulp is flowing in a less plug-flow like manner.

TABLE IV

| Paddle Type: Paddle Spacing (deg) | Paddle Type: Pitch | Paddle Type: Paddle Size | Paddle Type: Paddle Angle (deg) | Feed Rate (ODTPD) | Paddle Rotational Speed (RPM) | Fill Level (%) | Res. Time Pulp (Sec.) | Dispersion Index (DI) |
|---|---|---|---|---|---|---|---|---|
| 60 | Full | Stnd | 45 | 20 | 25 | 21 | 49 | 8.2 |
| 120 | Half | Stnd | 45 | 20 | 50 | 19 | 44 | 4.8 |
| 240 | Quarter | Small | 45 | 18 | 90 | 18 | 45 | 2.6 |

Example 5

Figure 13:
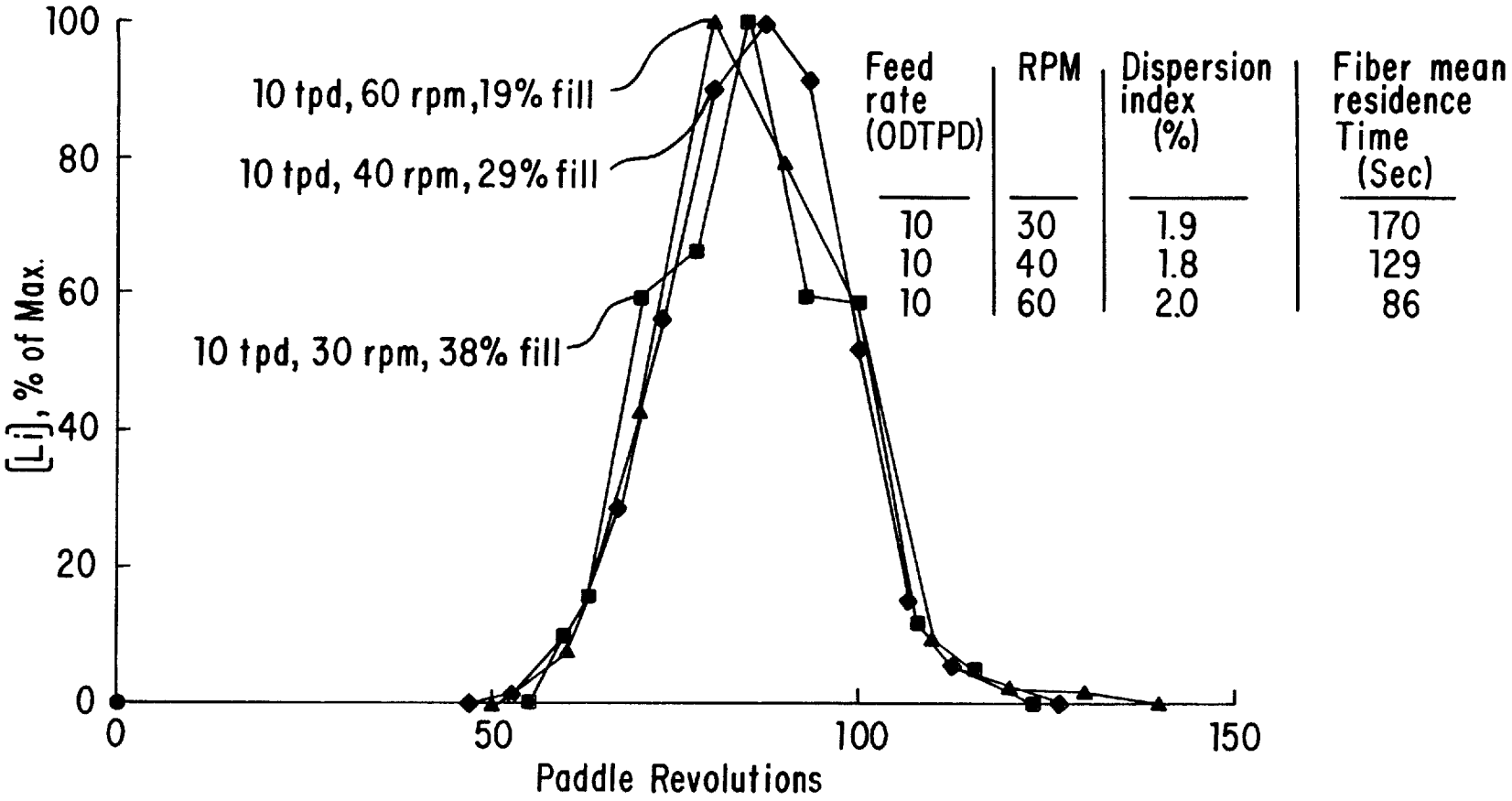
FIG. 13 is a graph of lithium concentration of pulp exiting the reactor vs. time after lithium-treated pulp is added at the reactor entrance for the paddle conveyor of Example 5.

A preferred paddle configuration is a 240 degree, one quarter pitch design using paddles having dimensions one half of the CEMA standard mounted at a 45 degree conveying angle. Use of this configuration provides a high ozone conversion efficiency as illustrated in the paddle conveyor of Example 2. Surprisingly, use of this configuration provides the additional benefit of maintaining a constant residence time distribution over a broad range of operating conditions and fiber residence times, thus ensuring uniformity of bleaching. This is illustrated by the lithium indicator data shown in FIG. 13.

Example 6

A comparison of counter-current and co-current gas flow resulted in favorable results for both directions of gas flow. An increase in efficiency, as illustrated in Table V, resulted from the use of counter-current gas flow.

TABLE V

| Gas Flow | Feed Rate (ODTPD) | Paddle Rotational Speed (RPM) | Gas Flow Rate (SCFM) | Ozone Appl. On Pulp (%) | Ozone Conversion (%) | Change in GEB Brightness (%) |
|---|---|---|---|---|---|---|
| Countercurrent | 20 | 50 | 35 | 0.9 | 92 | 15 |
| Cocurrent | 20 | 50 | 35 | 0.9 | 87 | 14 |

Example 7

The gas residence time within the reactor was adjusted to bring it to a level similar to that of the pulp residence time. The results, illustrated in Table VI below, demonstrate the nearly complete ozone conversion accomplished while attaining an excellent level of brightness increase.

TABLE VI

| Feed Rate (ODTPD) | Paddle Rotational Speed (RPM) | Gas Flow Rate | Ozone Appl. On Pulp (%) | Residence Time Gas | Residence Time Pulp | Ozone Conversion (%) | Change in GEB Brightness (%) |
|---|---|---|---|---|---|---|---|
| 20 | 40 | 35 | 0.9 | 42 | 57 | 95 | 15 |
| 19 | 40 | 50 | 1.1 | 29 | 57 | 80 | 14 |
| 20 | 40 | 95 | 1.3 | 15 | 57 | 74 | 16 |

Example 8

By altering the rotational speed of any particular configuration of paddles, the pulp residence time can be controlled so as to attain the desired target for ozone conversion, as illustrated below in Table VII. The data presented therein is for a 240° Q-STD 45° conveyor.

TABLE VII

| Feed Rate (ODTPD) | Paddle Rotational Speed (RPM) | Gas Flow Rate (SCPM) | Fill Level (%) | Residence Time Pulp (sec.) | Ozone Conversion (%) | Change in GEB Brightness (%) |
|---|---|---|---|---|---|---|
| 20 | 90 | 36 | 14 | 32 | 86 | 11 |
| 19 | 60 | 34 | 18 | 43 | 93 | 11 |

Example 9

The following tests were conducted to show the effects of a change in paddle design for a constant feed and same shaft RPM.

TABLE VIII

| Paddle Type | | | | | Paddle | | Res. | | Change |
|---|---|---|---|---|---|---|---|---|---|
| Paddle Spacing (deg) | Pitch | Paddle Size | Paddle Angle (deg) | Feed Rate (ODTPD) | Rotational Speed (RPM) | Fill Level (%) | Time Pulp (sec.) | Pulp Conversion (%) | in GEB Brightness (%) |
| 240 | Quarter | Stnd | 45 | 19 | 60 | 18 | 43 | 93 | 11 |
| 240 | Quarter | Small | 45 | 18 | 60 | 34 | 85 | 99 | 15 |

The data shows that a change to smaller paddles substantially reduces conveying efficiency while increasing fill level and pulp residence time in the reactor. These changes have resulted in improved bleaching performance as measured by ozone conversion and change in brightness.

Additional variations are shown in Example 10. From this information, one skilled in the art can best determine how to design and run a particular paddle conveyor reactor for the desired degree of bleaching on a particular pulp.

Example 10

The following Table IX summarizes the specific paddle design and operating conditions which were used to generate FIGS. 5 and 6. A pulp feed of 20 TPD and a reactor shell size of 19.5" I.D. were utilized, at a target fill level of about 20% for the first five rows of Table IX. Again, a 6 weight percent ozone bleaching agent was used at a flow rate of 35 SCFM to apply about 1% ozone on OD pulp.

The data in Table IX along with its graphical representation in FIGS. 5 and 6 illustrate the bleaching results possible over various operating ranges so as to determine optimal gas-pulp contact and ozone conversion levels. The data also teach how to change shaft RPM to control fill level and pulp residence time.

Example 11

To verify that the theoretical calculations presented in FIGS. 1 and 2 were representative of the actual operation of the paddle conveyor, a series of tests were made to determine pulp bridging in various paddle conveyors operated under different parameters. To conduct these tests, a 17" conveyor was fitted with a paddle shaft having five different paddle spacings—3.5", 4.7", 5.9", 7.2" and 9"—and was then operated as shown below in Table X. The actual pulp consolidation forces (PCF) in pounds per square foot were calculated and the minimum paddle spacing was estimated from the theoretical data and compared to the actual results.

TABLE IX

| Paddle Design | | | | OPERATING CONDITIONS | | RESULTS | |
|---|---|---|---|---|---|---|---|
| | | | | Fill Level | Pulp Res. | Ozone | |
| Spacing | Pitch | Size | Angle | RPM | Actual (%) | Time (S) | Conversion (%) |
| 60 | Full | Std. | 45 | 25 | 21 | 49 | 71 |
| 120 | Full | Large | 45 | 40 | 17 | 40 | 85 |
| 120 | Half | Std. | 45 | 60 | 16 | 38 | 89 |
| 240 | Quarter | Std. | 45 | 60 | 18 | 43 | 93 |
| 240 | Quarter | Small | 45 | 90 | 18 | 45 | 97 |
| 240 | Quarter | Small | 45 | 75 | 25 | 58 | * |
| 240 | Quarter | Small | 45 | 60 | 34 | 85 | 99 |
| 240 | Quarter | Small | 25 | 90 | 54 | 121 | * |
| 240 | Quarter | Small | 25 | 150 | 39 | 81 | 98 |

*Not Measured

TABLE X

| Fill (%) | RPM | PCF (PSF) | Estimated Minimum Paddle Spacing (*) To Avoid Bridging | Bridging observed for spacing of 3.5 | 4.7 | 5.9 | 7.2 | 9 |
|---|---|---|---|---|---|---|---|---|
| 25 | 50 | 12 | 5 | Yes | Yes | Yes | No | No |
| 25 | 90 | 25 | 7 | Yes | Yes | Yes | Some | No |
| 40 | 30 | 15 | 5.5 | Yes | Yes | Yes | No | No |
| 40 | 50 | 17 | 6 | Yes | Yes | Yes | Some | No |
| 40 | 70 | 25 | 7 | Yes | Yes | Yes | No | No |
| 40 | 90 | 35 | 8 | Yes | Yes | Yes | Some | No |

These data suggest that the theoretical calculations agree with the actual observations within ±1 inch, and that the theoretical calculations are useful for estimating minimum paddle spacing.

Example 12

Figure 14:
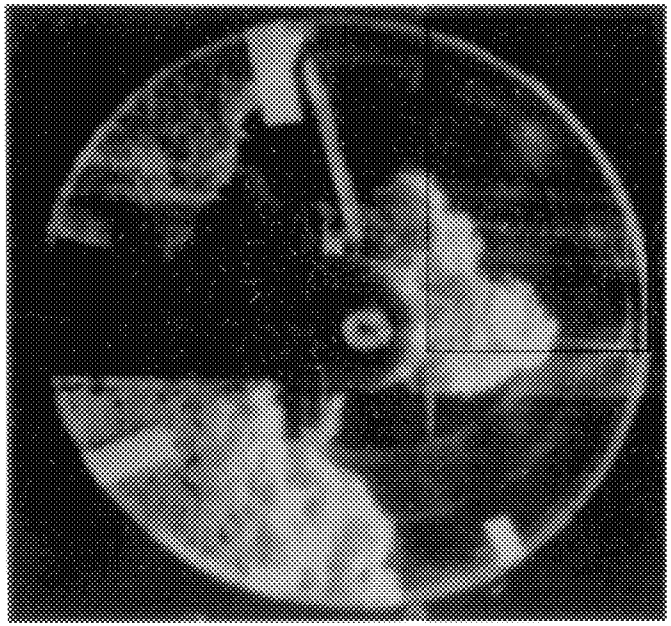
FIGS. 14–16 are photographs looking into the reactor along a line parallel with the shaft to show pulp dispersion as a function of various shaft speeds.
Figure 15:
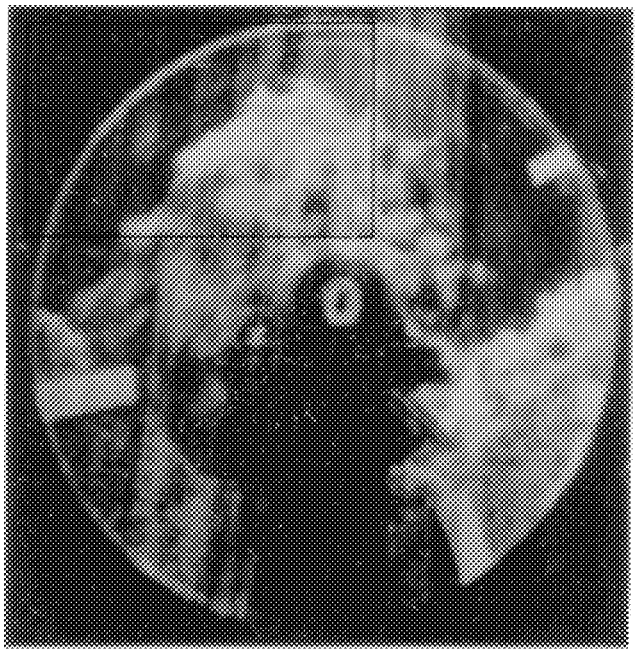
Figure 16:
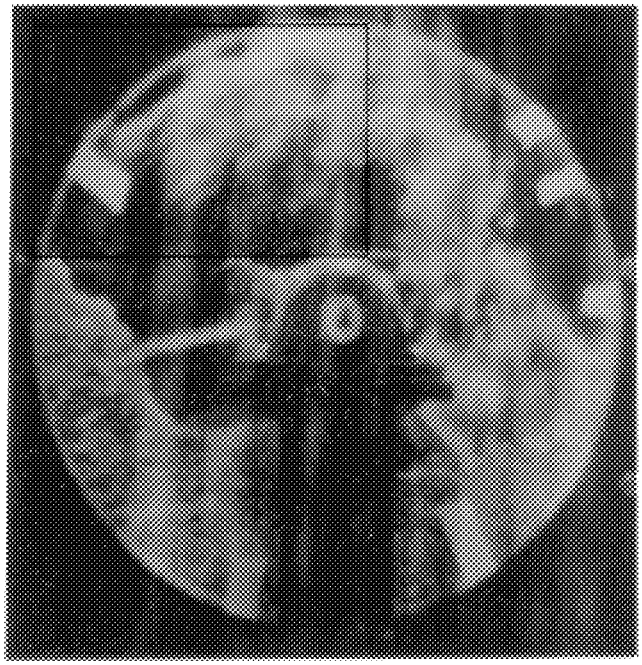

To determine the relative degree of dispersion of pulp into the open spaces of the reactor at different operating conditions, the following tests were conducted. A 17"240° quarter pitch standard size 45° paddle conveyor was operated at different RPM with counterclockwise rotation. The reactor had the same fill level for each test—about 25%. A camera was mounted at one end of the shaft and took stop-action photographs while the shaft was operating at different RPM when one of the blades was at a 12 o'clock position. Image analysis was done in a controlled area in the upper left portion of the reactor, and calculations were made to determine how much pulp occupied this area, since this is representative of the relative pulp dispersing properties of the conveyor when operated at the particular shaft speed. Results are shown below in Table XI and in FIGS. 14–16.

TABLE XI

| Rotational Speed (RPM) | % of Rectangle Showing Pulp |
|---|---|
| 20 | 22% |
| 40 | 47% |
| 60 | 58% |

This illustrates the greater pulp dispersing capabilities of the paddle conveyor when operated at higher RPM. As explained above, the fill level of the reactor is reduced when higher shaft RPM are used, but this data illustrates the benefits in pulp dispersion which can be achieved at higher RPM for the same fill level.

Example 13

The paddle conveyor can achieve excellent results over a wide range of pulp feed rates. For example, ozone conversions of at least 90% and similar levels of brightness increase achieved at both 18 ODTPD and 11 ODTPD feed rates, where at 11 ODTPD the paddle rotational speed was decreased to maintain an approximately constant fill level in the reactor, as shown below in Table XII.

TABLE XII

| Feed Rate (OPTPD) | Paddle Rotational Speed (RPM) | Fill Level (%) | Ozone Conversion (%) | Change in GEB Brightness (%) |
|---|---|---|---|---|
| 19 | 60 | 36 | 93 | 13 |
| 11 | 30 | 40 | 90 | 12 |

While it is apparent that the invention herein disclosed is well calculated to fulfill the objects above stated, it will be appreciated that numerous modifications and embodiments may be devised by those skilled in the art. For example, in addition to the preferred paddle conveyors, other conveying elements such as cut and folded screw flights, ribbon mixers, elbow shaped lifting elements and wedge shaped flight elements can be used, as shown in FIGS. 17–20. It is intended that the appended claims cover all such modifications and embodiments as fall within the true spirit and scope of the present invention.

What is claimed is:

1. An apparatus for dispersing high consistency pulp particles into a gaseous bleaching agent comprising:

a shell;

means for providing high consistency pulp particles having a consistency of at least about 20%, said providing means operatively associated with means for introducing the high consistency pulp particles into the shell;

means for generating a gaseous bleaching agent that contains ozone, said generating means operatively associated with means for introducing said gaseous bleaching agent into the shell; and means for conveying the pulp particles through the shell at a certain conveying speed and certain conveying efficiency, the conveying means comprising:

means for reducing the certain conveying efficiency of the conveying means, including dispersing means for intimately contacting and mixing the pulp particles and the gaseous bleaching agent by simultaneously exposing substantially all surfaces of a majority of the pulp particles to the gaseous bleaching agent as the gaseous bleaching agent flows and surrounds the pulp particles to allow approximately equal access of the gaseous bleaching agent to the pulp particles by lifting, displacing and tossing the pulp particles in a radial direction to disperse the pulp particles and suspend at least a portion of the pulp particles in the gaseous bleaching agent while the dispersed and exposed pulp particles advance through the shell in an axial direction; and means for increasing the certain conveying speed of the conveying means operatively associated with the dispersing means to provide a predetermined fill level of at least 10% of the pulp particles in the shell and to advance the dispersed pulp particles through the shell in a plug-flow like manner at a dispersion index of less than 8.

2. An apparatus for dispersing high consistency pulp particles into a gaseous bleaching agent comprising:

a shell;

means for providing high consistency pulp particles having a consistency of at least about 20%, said providing means operatively associated with means for introducing the high consistency pulp particles into the shell;

means for generating a gaseous bleaching agent that contains ozone, said generating means operatively associated with means for introducing said gaseous bleaching agent into the shell;

particle conveying means for conveying the pulp particles through the shell at a certain conveying speed and certain conveying efficiency while providing a predetermined fill level of at least 10% of the pulp particles in the shell, the particle conveying means comprising:

means for reducing the certain conveying efficiency, including dispersing means for intimately contacting and mixing the pulp particles and the gaseous bleaching agent by simultaneously exposing substantially all surfaces of a majority of the pulp particles to the gaseous bleaching agent as the gaseous bleaching agent flows and surrounds the pulp particles to allow approximately equal access of the gaseous bleaching agent to the pulp particles by lifting, displacing and tossing the pulp particles in a radial direction to disperse the pulp particles and suspend at least a portion of the pulp particles in the gaseous bleaching agent while the dispersed and exposed pulp particles advance through the shell in an axial direction; and means for increasing the certain conveying speed in combination and operatively associated with the means for reducing the conveying efficiency to advance the dispersed pulp particles through the shell in a plug-flow like manner at a dispersion index of less than about 8 at the predetermined fill level.

3. An apparatus for dispersing high consistency pulp particles into a gaseous bleaching agent comprising:

a shell including a particle introduction zone, a particle fill level providing zone, at least one particle/gaseous bleaching agent mixing zone, and a particle exit zone;

means for providing high consistency pulp particles having a consistency of at least about 20%, said providing means operatively associated with means for introducing the high consistency pulp particles into the particle introduction zone of the shell;

means for generating a gaseous bleaching agent that contains ozone, said generating means operatively associated with means for introducing said gaseous bleaching agent into the shell;

conveying means for conveying the pulp particles through the shell at a certain conveying speed and pertain conveying efficiency, the conveying means comprising:

means for providing a predetermined fill level of at least about 10% the high consistency pulp particles in the shell, said fill providing means located in the particle fill level providing zone of the shell;

dispersing means for intimately contacting and mixing the pulp particles and the gaseous bleaching agent by simultaneously exposing substantially all surfaces of a majority of the pulp particles to the gaseous bleaching agent as the gaseous bleaching agent flows and surrounds the pulp particles to allow approximately equal access of the gaseous bleaching agent to the pulp particles by lifting, displacing and tossing the pulp particles in a radial direction while the dispersed and exposed pulp particles advance through the shell in an axial direction; and means for increasing the certain conveying speed in combination and operatively associated with means for reducing the certain conveying efficiency to advance the dispersed pulp particles through the shell in a plug-flow like manner at a dispersion index of less than about 8 at the predetermined fill level; and means for removing the pulp particles from the particle exit zone of the shell.

4. The apparatus of claim 3 wherein the fill providing means comprises a portion of the conveying means which has a different conveying efficiency.

5. The apparatus of claim 4 wherein the fill providing means comprises a first conveyor section and the conveying means comprises a second conveyor section, wherein the first conveyor section has a greater conveying rate than the second conveyor section.

6. The apparatus of claim 6 wherein the shell includes first and second shell sections, with the first shell section including the particle introduction zone, the particle fill level providing zone and a first pulp particle/bleaching agent reaction zone, with the second shell section including a second pulp particle/bleaching agent reaction zone and the particle exit zone.

7. The apparatus of claim 6 wherein the first shell section is positioned above the second shell section and is connected thereto by a conduit, the first and second conveyor sections are located in the first shell section, the second shell section includes a third conveyor section having conveying elements mounted upon a shaft for directing the pulp particles through the second reaction zone to the particle exit zone.

8. The apparatus of claim 7 wherein the first and second shell sections face in opposite directions, with the shaft of the third conveyor section and its conveying elements arranged to convey the pulp particles in a direction opposite to that of the first and second conveyor sections, such that each shaft is rotated in the same direction by single driving means.

9. The apparatus of any one of claims 1, 2 or 3 wherein said particle conveying means comprises a shaft; said dispersing means comprises a plurality of paddle members mounted upon the shaft; said conveying efficiency reducing means comprises means for modifying at least one of the size, shape, configuration, and orientation of said paddle members with respect to the shaft; and said conveying speed increasing means comprises means for increasing the RPM of the shaft to compensate for the paddle member modifying means and obtain said plug flow.

10. The apparatus of any one of claims 1, 2 or 3 wherein the means for generating the gaseous bleaching agent comprises an ozone generator.

11. The apparatus of any one of claims 1, 2 or 3 wherein the means for providing high consistency pulp particles comprises means for removing liquid from low or medium consistency pulp.

12. The apparatus of claim 11 wherein the means for providing high consistency pulp particles further comprises means for acidifying the pulp particles.

13. The apparatus of any one of claims 1, 2 or 3 wherein the high consistency pulp particles are acidified, the predetermined fill level is at least about 15%, the conveying means comprises a shaft and the dispersing means comprises a plurality of paddle blades mounted upon the shaft at a predetermined pitch.

14. The apparatus of any one of claims 1, 2 or 3 further comprising means for comminuting the high consistency pulp particles prior to introducing the pulp particles into the shell.

15. The apparatus of claim 10 which further comprises means for recycling spent gaseous bleaching agent from the shell to the ozone generator.

16. The apparatus of any one of claims 1, 2 or 3 wherein the shell is tilted from the horizontal so as to utilize the force of gravity to assist in the advancement of the pulp particles.

17. The apparatus of any one of claims 1, 2 or 3 wherein the conveying means comprises a shaft extending through the shell along a longitudinal axis thereof, and the dispersing means comprises means extending generally radially from the shaft to move the pulp particles in both a radial direction and an axial direction.

18. The apparatus of claim 17 wherein the means extending radially from the shaft comprises a plurality of paddle blades positioned and oriented in a predetermined pattern defining the pitch of the dispersing means.

19. The apparatus of claim 17 wherein the means extending radially from the shaft comprises a continuous screw flight defining the pitch of the dispersing means and having a plurality of portions which are cut out from the flight to form openings therein, said cut portions being bent at a predetermined angle with respect to the shaft.

20. The apparatus of claim 17 wherein the means extending radially from the shaft comprises a continuous screw flight defining the pitch of the dispersing means and having a plurality of lifting elements attached thereto.

21. The apparatus of claim 17 wherein the means extending radially from the shaft comprises a ribbon blade defining the pitch of the dispersing means.

22. The apparatus of claim 17 wherein the means extending radially from the shaft comprises an inclined ribbon having infinite pitch.

23. The apparatus of claim 17 wherein the means extending radially from the shaft included elements spaced at a sufficient distance axially along the shaft to minimize or avoid bridging or plugging of the pulp particles therebetween.

* * * * *